US011731440B2

(12) United States Patent
Osakabe et al.

(10) Patent No.: US 11,731,440 B2
(45) **Date of Patent: *Aug. 22, 2023**

(54) IMAGE RECORDING APPARATUS CONFIGURED TO GENERATE DATA INDICATING CORRESPONDENCE BETWEEN SUPPLY TRAY AND DISCHARGE TRAY

(71) Applicant: BROTHER KOGYO KABUSHIKI KAISHA, Nagoya (JP)

(72) Inventors: Yoshinori Osakabe, Seto (JP); Satoshi Miyase, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/875,713

(22) Filed: Jul. 28, 2022

(65) Prior Publication Data

US 2022/0363077 A1 Nov. 17, 2022

Related U.S. Application Data

(63) Continuation of application No. 17/215,718, filed on Mar. 29, 2021, now Pat. No. 11,400,737.

(30) Foreign Application Priority Data

Mar. 31, 2020 (JP) ..... 2020-064253

(51) Int. Cl.
*B41J 13/00* (2006.01)
*B41J 11/58* (2006.01)
(Continued)

(52) U.S. Cl.
CPC ..... *B41J 13/0009* (2013.01); *B41J 3/46* (2013.01); *B41J 3/543* (2013.01); *B41J 11/58* (2013.01);
(Continued)

(58) Field of Classification Search
CPC . B41J 13/0009; B41J 3/46; B41J 3/543; B41J 11/58; B41J 13/0018; B41J 13/103; B41J 13/106; B41J 11/006; B41J 11/0095
See application file for complete search history.

(56) References Cited

U.S. PATENT DOCUMENTS

| | | | | |
|---|---|---|---|---|
| 8,882,103 | B2 | 11/2014 | Samoto | |
| 11,400,737 | B2 * | 8/2022 | Osakabe | B41J 11/58 |
| 2010/0124449 | A1 | 5/2010 | Asada et al. | |

FOREIGN PATENT DOCUMENTS

JP 8-337011 A 12/1996

OTHER PUBLICATIONS

Notice of Allowance dated Apr. 6, 2022 from parent U.S. Appl. No. 17/215,718.

* cited by examiner

*Primary Examiner* — Henok D Legesse
(74) *Attorney, Agent, or Firm* — Scully, Scott, Murphy & Presser, PC

(57) ABSTRACT

An upper supply tray is mounted at an upper mount position in a housing. A lower supply tray is mounted at a lower mount position lower than the upper mount position in the housing. A first print engine records an image on a sheet conveyed from the upper supply tray. A second print engine records an image on a sheet conveyed from the lower supply tray. A lower discharge tray supports the sheet on which the image is recorded by the first print engine. An upper discharge tray supports the sheet on which the image is recorded by the second print engine. The upper discharge tray is located at a higher position than the lower discharge tray. A first display displays at least: a first correspondence between the lower discharge tray and the upper supply tray; or a second correspondence between the upper discharge tray and the lower supply tray.

21 Claims, 14 Drawing Sheets

(51) Int. Cl.

| | |
|---|---|
| ***B41J 3/54*** | (2006.01) |
| ***B41J 3/46*** | (2006.01) |
| ***B41J 13/10*** | (2006.01) |
| *B41J 11/00* | (2006.01) |

(52) U.S. Cl.
CPC ..... *B41J 13/0018* (2013.01); *B41J 13/103* (2013.01); *B41J 13/106* (2013.01); *B41J 11/006* (2013.01); *B41J 11/0095* (2013.01)

IMAGE RECORDING APPARATUS CONFIGURED TO GENERATE DATA INDICATING CORRESPONDENCE BETWEEN SUPPLY TRAY AND DISCHARGE TRAY

CROSS REFERENCE TO RELATED APPLICATIONS

This application is a continuation application of U.S. Ser. No. 17/215,718 filed on Mar. 29, 2021 and claims priority from Japanese Patent Application No. 2020-064253 filed Mar. 31, 2020. The entire contents of each of which are incorporated herein by reference.

TECHNICAL FIELD

This disclosure relates to an image recording apparatus.

BACKGROUND

In a known image recording apparatus, a sheet on an upper supply tray is discharged from a lower discharge port to a lower discharge tray after an image is recorded. A sheet on a lower supply tray is discharged from an upper discharge port to an upper discharge tray after an image is recorded.

SUMMARY

According to one aspect, this specification discloses an image recording apparatus. The image recording apparatus includes a housing, an upper supply tray, a lower supply tray, a first print engine, a second print engine, a lower discharge tray, an upper discharge tray, and a first display. The upper supply tray is mounted at an upper mount position in the housing and configured to support a sheet. The lower supply tray is mounted at a lower mount position in the housing and configured to support a sheet. The lower mount position is lower than the upper mount position. The first print engine is configured to record an image on the sheet conveyed from the upper supply tray. The second print engine is configured to record an image on the sheet conveyed from the lower supply tray. The lower discharge tray is configured to support the sheet on which the image is recorded by the first print engine. The upper discharge tray is configured to support the sheet on which the image is recorded by the second print engine. The upper discharge tray is located at a higher position than the lower discharge tray. The first display is configured to display at least: a first correspondence between the lower discharge tray and the upper supply tray; or a second correspondence between the upper discharge tray and the lower supply tray.

BRIEF DESCRIPTION OF THE DRAWINGS

Embodiments in accordance with this disclosure will be described in detail with reference to the following figures wherein:

FIGS. 14A to 14E are schematic views showing other modifications of marks 500 and so on.

DETAILED DESCRIPTION

Figure 1:
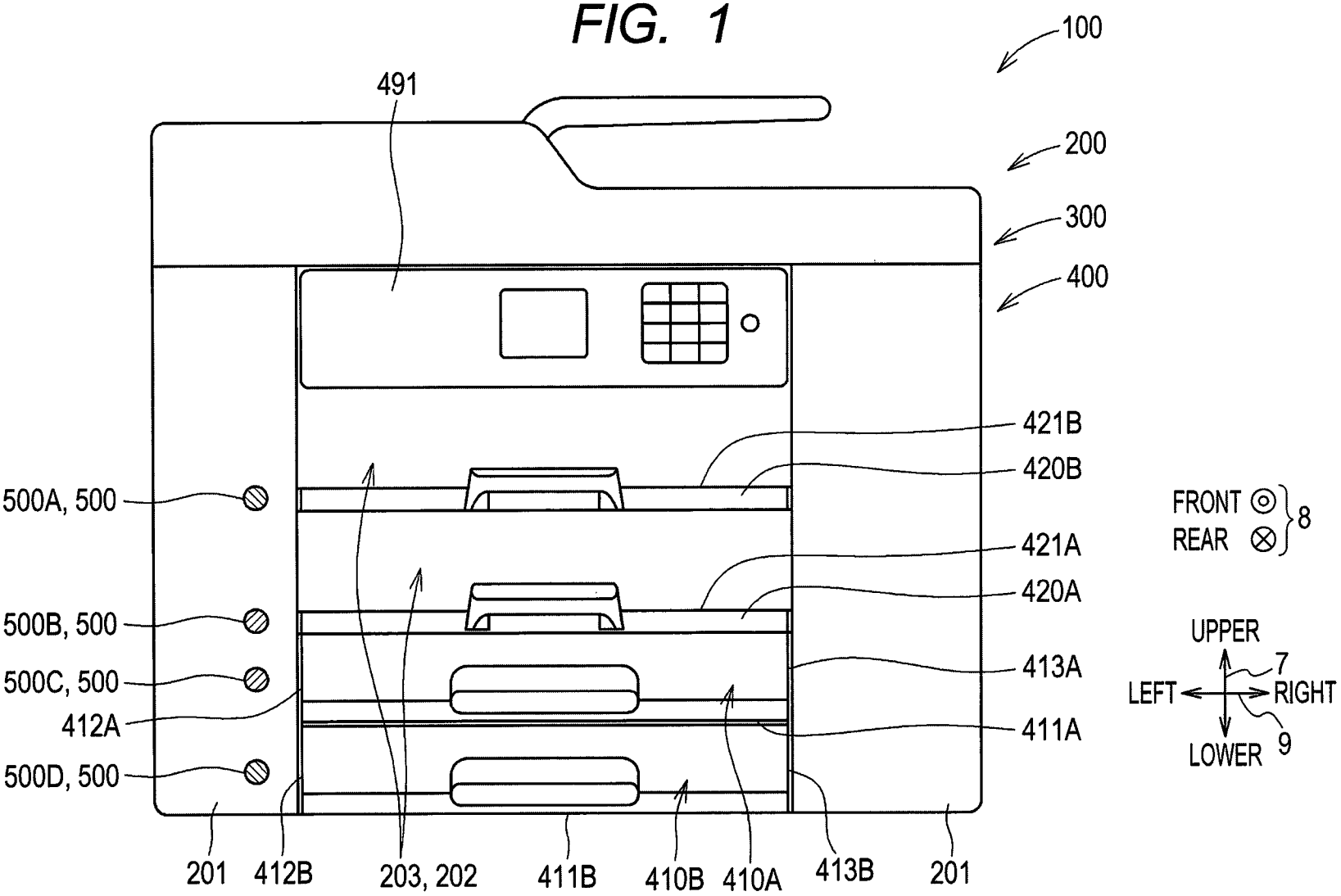
FIG. 1 is a front view schematically showing a multi-function peripheral (MFP) 100.

With the above-mentioned image recording apparatus, it is difficult for the user to grasp the correspondence between the supply trays and the discharge trays. Thus, for example, the following inconveniences may occur.

When a jam occurs in a conveyance path of the image recording apparatus, the leading end of a sheet may be slightly seen from the lower discharge port. In order to eliminate this jam, the user may remove a supply tray from the housing and then puts his or her hand into the housing space of the supply tray to remove the sheet that is jammed in the conveyance path. However, if the correspondence is not grasped in advance, the user may mistakenly pull out the lower supply tray before the upper supply tray.

Further, in the image recording apparatus, there is a case where the upper supply tray and the lower supply tray support different types of sheets. An information processing apparatus transmits a job for which the sheet type is specified to the image recording apparatus according to the user's operation. The image recording apparatus records an image on a sheet of the type specified by the job and discharges the sheet. However, if the user does not grasp the correspondence in advance, the user may see that a printed matter different from the sheet type specified by the user is discharged from the image recording apparatus and mistakenly think that he or she specified the sheet type incorrectly.

In view of the foregoing, an aspect of an objective of this disclosure is to provide an image recording apparatus in which it is easy to understand the correspondence between the supply trays and the discharge trays.

Hereinafter, embodiments of the present disclosure will be described with reference to the drawings as appropriate. The embodiments described below are merely examples of the present disclosure, and the embodiments can be appropriately changed without departing the scope of the claims. In the following description, a vertical direction 7 is defined based on the state (the state of FIG. 1) in which a multi-function peripheral (MFP) 100 is usable, a front-rear direction 8 is defined with a surface having an opening 202 (that is, a front surface 201) as the front side, and a left-right direction 9 is defined when the MFP 100 is viewed from the front surface 201 side. The vertical direction 7, the front-rear direction 8 and the left-right direction 9 are perpendicular to each other. In the following description, the direction from the start point to the end point of an arrow is expressed as an orientation, and the line connecting the start point and the end point of the arrow is expressed as a direction. In other words, an orientation is a component of a direction.

[Schematic Configuration of MFP 100]

As shown in FIG. 1, the MFP 100 includes a housing 200. The housing 200 is an exterior body having a substantially rectangular parallelepiped shape, and is supported by various frames.

In FIG. 1, the MFP 100 includes a scanner unit 300 at the upper part of the housing 200 and a printer unit 400 at the lower part of the housing 200. The scanner unit 300 optically reads a document. The printer unit 400 records an image on sheets 1A and 1B (see FIG. 2). Sheets 1A and 1B are paper and OHP sheets. The MFP 100 may have a facsimile function and so on. The printer unit 400 is an example of an image recording apparatus.

Figure 2:
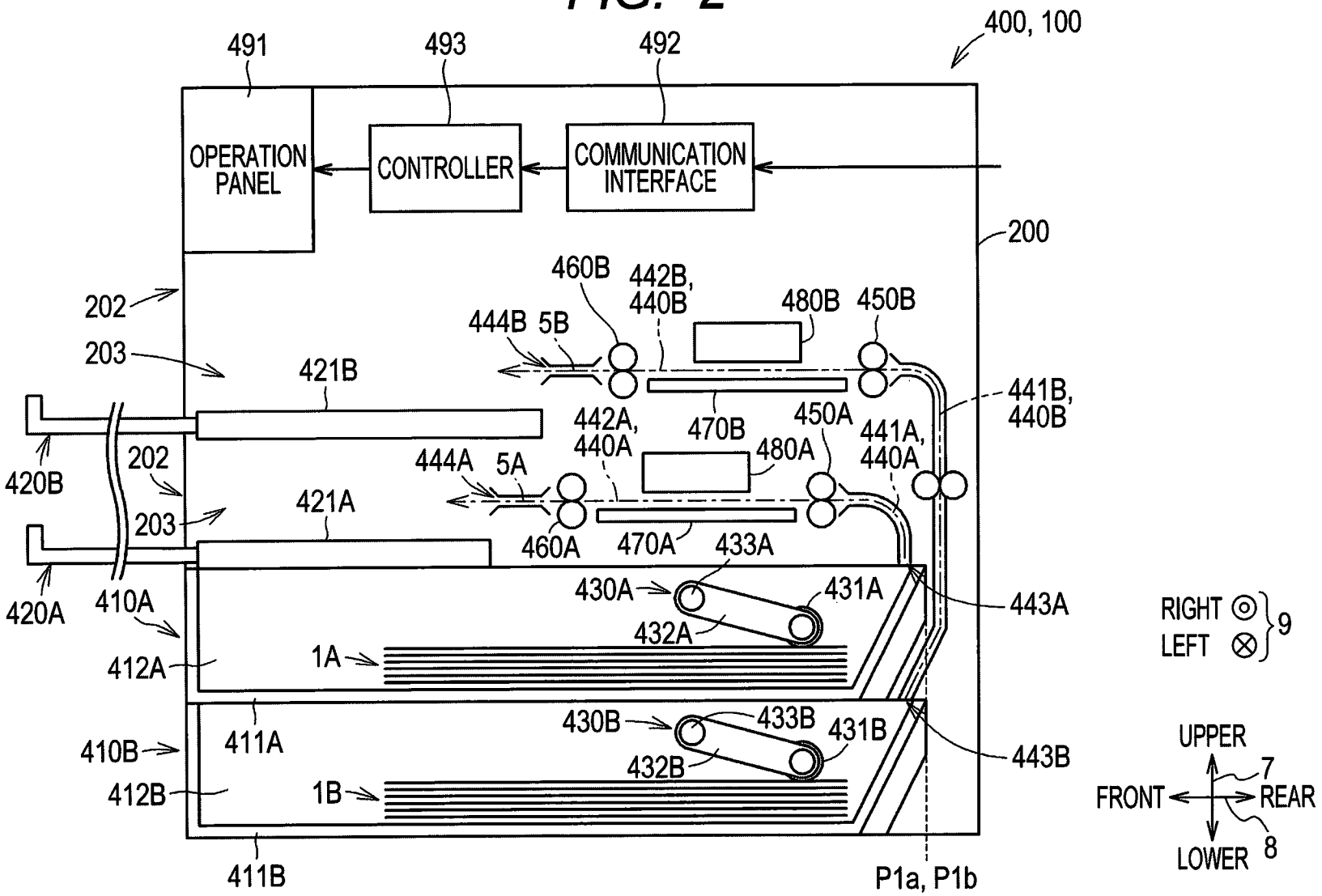
FIG. 2 is a vertical cross-sectional view schematically showing the internal structure of the MFP 100 of FIG. 1.

As shown in FIGS. 1 and 2, the printer unit 400 roughly includes supply trays 410A and 410B, discharge trays 420A and 420B, feed mechanisms 430A and 430B, conveyance roller pairs 450A and 450B, discharge roller pairs 460A and 460B, platens 470A and 470B, recording heads 480A and 480B, an operation panel 491, a communication interface 492, a controller 493, and a first display 500. Conveyance paths 440A and 440B are formed in the housing 200.

The supply trays 410A and 410B are examples of an upper supply tray and a lower supply tray. The discharge trays 420A and 420B are examples of a lower discharge tray and an upper discharge tray. The conveyance paths 440A and 440B are examples of an inner conveyance path (first conveyance path) and an outer conveyance path (second conveyance path). The combination of the platen 470A and the recording head 480A is an example of a first recording engine. The combination of the platen 470B and the recording head 480B is an example of a second recording engine.

[Supply trays 410A and 410B]

As shown in FIG. 1, the housing 200 has the front surface 201. The opening 202 is formed in the center portion of the front surface 201 in the left-right direction 9. The opening 202 has a rectangular shape that is long in the vertical direction 7 when viewed from the front. The housing 200 is formed with an internal space 203 that is open forward through the opening 202. That is, the internal space 203 extends rearward from the opening 202.

In FIG. 1, the supply tray 410B is inserted into the internal space 203 through a portion of the opening 202 near the lower end of the housing 200. The supply tray 410A is inserted into the internal space 203 through a portion of the opening 202 directly above the supply tray 410B. The supply trays 410A and 410B move rearward while being guided on guide rails for the supply trays 410A and 410B in the housing 200, and thereby installed to mount positions P1*a* and P1*b* (see FIG. 2) in the housing 200, respectively. The supply trays 410A and 410B are pulled out from the housing 200 by moving forward while being guided on the respective guide rails from the mount positions P1*a* and P1*b*.

In FIG. 2, the supply tray 410A has a box-like shape which is thin in the vertical direction 7. The upper end of the supply tray 410A is open. A plurality of sheets 1A is supported in a stacked state on the bottom portion of the supply tray 410A. The bottom portion of the supply tray 410A is also provided with a side guide and so on for aligning the center of the sheet 1A in the width direction with the center of the conveyance path 440A in the left-right direction 9.

Since the configuration of the supply tray 410B is similar to the supply tray 410A, its detailed description will be omitted. The supply tray 410B supports the sheet 1B. The sheet 1B may have the same size and type as the sheet 1A, or may have a different size and type from the sheet 1A.

[Discharge Trays 420A and 420B]

As shown in FIGS. 1 and 2, the discharge tray 420A is located above the supply tray 410A in the internal space 203. The discharge tray 420A has a support surface 421A extending forward from immediately below a discharge port 444A of the conveyance path 440A and extending in the front-rear direction 8 and the left-right direction 9.

The discharge tray 420B is located in the internal space 203 upward from the discharge tray 420A and downward from the operation panel 491. The discharge tray 420B has a support surface 421B that extends forward from below the discharge port 444B of the conveyance path 440B and extends in the front-rear direction 8 and the left-right direction 9.

Each of the support surfaces 421A and 421B has a substantially rectangular shape when viewed from above. The support surfaces 421A and 421B support the sheets 1A and 1B discharged from the discharge ports 444A and 444B. The user takes out the sheets 1A and 1B on the support surfaces 421A and 421B through the opening 202.

[Feed Mechanisms 430A and 430B]

As shown in FIG. 2, the feed mechanism 430A is located between the supply tray 410A at the mount position P1*a* and the platen 470A in the vertical direction 7. The feed mechanism 430A includes a feed roller 431A and a feed arm 432A, and transmits the driving force of a conveyance motor (not shown) to the feed roller 431A by a drive transmission mechanism (not shown) housed in the feed arm 432A. Thus, the feed roller 431A rotates forward and feeds the uppermost sheet 1A supported by the supply tray 410A to a supply port 443A of the conveyance path 440A.

The feed mechanism 430B is located between the supply tray 410B at the mount position P1*b* and the supply tray 410A at the mount position P1*a* in the vertical direction 7. The feed mechanism 430B includes a feed roller 431B and a feed arm 432B, and feeds the uppermost sheet 1B supported by the supply tray 410B to a supply port 443B of the conveyance path 440B in a similar manner to the feed mechanism 430A.

[Conveyance Paths 440A and 440B]

As shown by the single-dot chain line in FIG. 2, the conveyance path 440A extends from the rear end of the supply tray 410A at the mount position P1*a* in the housing 200. The conveyance path 440A is a conveyance path for the sheet 1A and has a so-called U-turn shape.

The conveyance path 440A has a curved portion 441A (upward portion) and a straight portion 442A.

The curved portion 441A has the supply port 443A just above the rear end of the supply tray 410A at the mount position Pla. The curved portion 441A extends upward from the supply port 443A and extends forward. The curved portion 441A is formed by an inner guide member and an intermediate guide member (not shown).

The straight portion 442A is continuous with the downstream end of the curved portion 441A and extends substantially linearly forward from the downstream end of the curved portion 441A to reach the discharge port 444A.

As shown by the double-dot chain line in FIG. 2, the conveyance path 440B extends from the rear end of the supply tray 410B at the mount position P1*b* in the housing 200. The conveyance path 440B is a conveyance path for the sheet 1B and has a so-called U-turn shape.

The conveyance path 440B has a curved portion 441B (upward portion) and a straight portion 442B.

The curved portion 441B has the supply port 443B just above the rear end of the supply tray 410B at the mount position P1*b*. The curved portion 441B extends upward from the supply port 443B through the outside of the curved portion 441A while being curved. The curved portion 441B bends forward at a higher position than the conveyance path 440A. The curved portion 441B is formed by the intermediate guide member and an outer guide member (not shown).

The straight portion 442B is continuous with the downstream end of the curved portion 441B, extends substantially linearly forward from the downstream end of the curved portion 441B, passes above the straight portion 442A, and reaches the discharge port 444B. The discharge port 444B is located rearward of the discharge port 444A in the front-rear direction 8.

In FIG. 2, the sheets 1A and 1B are conveyed through the conveyance paths 440A and 440B in conveyance directions 5A and 5B, respectively. Specifically, in the curved portions 441A and 441B, the sheets 1A and 1B are conveyed to the conveyance roller pairs 450A and 450B, respectively, while being guided mainly by the intermediate guide member and the outer guide member. The sheets 1A and 1B are nipped by the rotating conveyance roller pairs 450A and 450B, and are conveyed forward, respectively. In the straight portions 442A and 442B, the sheets 1A and 1B pass directly below the recording heads 480A and 480B while being supported by the upper surfaces of the platens 470A and 470B, respectively. During this time, ink is ejected from the recording heads 480A and 480B to the sheets 1A and 1B, respectively. As a result, images are recorded on the sheets 1A and 1B. After that, the sheets 1A and 1B are conveyed to the discharge roller pairs 460A and 460B, respectively. The sheets 1A and 1B are nipped by the rotating discharge roller pairs 460A and 460B, are further conveyed forward, and then discharged from the discharge ports 444A and 444B to the discharge trays 420A and 420B, respectively.

[Conveyance Roller Pairs 450A and 450B]

As shown in FIG. 2, the conveyance roller pair 450A includes two rollers in contact with each other at the downstream end of the curved portion 441A (that is, the upstream end of the straight portion 442A). One of the two rollers extends in the left-right direction 9 along the conveyance path 440A above the conveyance path 440A. The one of the two rollers is rotated by a driving force generated by a conveyance motor (not shown). The other of the two rollers contacts the one roller from below and is rotated by following the rotation of the one roller.

The conveyance roller pair 450B is the same as the conveyance roller pair 450A except that the conveyance roller pair 450B is located at the downstream end of the curved portion 441B (that is, the upstream end of the straight portion 442B). Thus, the conveyance roller pair 450B will not be described in detail.

[Discharge Roller Pairs 460A and 460B]

As shown in FIG. 2, the discharge roller pairs 460A includes two rollers in contact with each other at a position which is separated from the conveyance roller pair 450A in the conveyance direction 5A and slightly upstream of the discharge port 444A in the conveyance direction 5A. One of the two rollers extends in the left-right direction 9 along the conveyance path 440A below the conveyance path 440A. The one of the two rollers is rotated by a driving force generated by the conveyance motor (not shown). The other of the two rollers is a spur, which contacts the one roller from above and is rotated by following the rotation of the one roller.

The discharge roller pair 460B is the same as the discharge roller pair 460A except that the discharge roller pair 460B is located at a position which is separated from the conveyance roller pair 450B in the conveyance direction 5B and slightly upstream of the discharge port 444B in the conveyance direction 5B. Thus, the discharge roller pair 460B will not be described in detail.

[Platens 470A and 470B]

In FIG. 2, the platen 470A has a support surface extending in the front-rear direction 8 and the left-right direction 9 directly below the straight portion 442A at a position between the conveyance roller pair 450A and the discharge roller pair 460A in the conveyance direction 5A.

The platen 470B has a support surface extending in the front-rear direction 8 and the left-right direction 9 directly below the straight line portion 442B at a position between the conveyance roller pair 450B and the discharge roller pair 460B in the conveyance direction 5B.

The platens 470A and 470B support the sheets 1A and 1B conveyed along the straight portions 442A and 442B, respectively.

[Recording Heads 480A and 480B]

As shown in FIG. 2, the recording heads 480A and 480B are located above (spaced from) the platens 470A and 470B in the vertical direction 7, respectively. The positions of the recording heads 480A and 480B in the left-right direction 9 are substantially the same. The recording head 480B is located to be shifted rearward from the recording head 480A in the front-rear direction 8. With this arrangement, the two recording heads 480A and 480B can be arranged in the vertical direction 7 in a space which is small in the vertical direction 7. Alternatively, the position of the recording head 480B in the front-rear direction 8 may be the same as that of the recording head 480A.

The recording heads 480A and 480B eject ink to the sheets 1A and 1B supported by the platens 470A and 470B. With this operation, images are recorded on the sheets 1A and 1B. Each of the recording heads 480A and 480B may be a serial head or a line head. Further, the recording heads 480A and 480B record an image by an inkjet method. Alternatively, an image may be recorded by an electrophotographic method, a thermal transfer method, and so on.

[Communication Interface 492]

The MFP 100 receives data from an external information processing apparatus (not shown) through a data transmission line. The data transmission line is a communication network composed of a wired LAN, a wireless LAN, a WAN, or a combination thereof. The data transmission line may be a USB cable. The MFP 100 may be configured to perform mutual data communication with the information processing apparatus.

In FIG. 2, the communication interface 492 receives a job transmitted by the information processing apparatus through the data transmission line. The job is an image recording instruction, and includes at least image data and condition information. The image data indicates an image to be recorded in the MFP 100. The condition information indicates the conditions for image recording and includes sheet information and so on. The sheet information is the size, type, and so on, of the sheet used for image recording.

[Controller 493]

In FIG. 2, the controller 493 includes a CPU, a ROM, a RAM, an EEPROM, an ASIC, and so on mounted on a control circuit board provided in the housing 200. The CPU, the ROM, the RAM, the EEPROM, and the ASIC are connected to each other so as to communicate with each other through an internal bus. The ROM stores a program for controlling the operation of the MFP 100, and so on. The CPU executes the program while using the RAM or the EEPROM.

In response to receiving a job transmitted by the information processing apparatus through the communication interface 492, the controller 493 controls each component of the printer unit 400 in order to record an image based on the image data according to the condition information.

Specifically, the controller 493 controls the printer unit 400 so as to record an image based on the image data included in one of two jobs by using the recording head 480A and to record an image based on the image data included in the other job by using the recording head 480B.

In addition, in a case where one job includes image data indicating a plurality of images, the controller 493 may control the printer unit 400 so as to record a part of the images by using the recording head 480A and to record the remaining images by using the recording head 480B.

[First Display 500]

As described above, the sheet 1A in the upper supply tray 410A among the supply trays 410A, 410B is discharged to the lower discharge tray 420A among the discharge trays 420A, 420B. The sheet 1B in the lower supply tray 410B is discharged to the upper discharge tray 420B. Thus, it is difficult for the user to grasp that the discharge tray 420A corresponds to the supply tray 410A and that the discharge tray 420B corresponds to the supply tray 410B. In order to help the user to grasp this correspondence, the MFP 100 includes a first display 500 as shown in FIG. 1.

The first display 500 includes marks 500A to 500D. Each of the marks 500A and 500D is an example of a second mark. Each of the marks 500B and 500C is an example of a first mark.

Each of the marks 500A to 500D is located on the front surface 201 at the left side of the supply trays 410A, 410B and the discharge trays 420A, 420B. Alternatively, each of the marks 500A to 500D may be located on the front surface 201 at the right side of the supply tray 410A and so on.

The mark 500A is located closer to the discharge tray 420B than to the discharge tray 420A. Specifically, the position of the mark 500A in the vertical direction 7 is substantially the same as that of the discharge tray 420B.

The mark 500B is located closer to the discharge tray 420A than to the discharge tray 420B. Specifically, the position of the mark 500B in the vertical direction 7 is substantially the same as that of the discharge tray 420A.

The mark 500C is located closer to the supply tray 410A than to the supply tray 410B. Specifically, the mark 500C is located near the center of the supply tray 410A in the vertical direction 7.

The mark 500D is located closer to the supply tray 410B than to the supply tray 410A. Specifically, the mark 500D is located near the center of the supply tray 410B in the vertical direction 7.

Each of the marks 500A to 500D is a mark in which the same outline is colored with paint. The colors of the marks 500A and 500D are the same as each other, and the colors of the marks 500B and 500C are the same as each other. That is, the color of the marks 500B and 500C is an example of one mode, and the color of the marks 500A and 500D is an example of another mode.

Operations and Effects of the Embodiment

Due to the above positional relationship and the color correspondence, the combination of the marks 500B and 500C indicates a first correspondence that the discharge tray 420A corresponds to the supply tray 410A. The combination of the marks 500A and 500D indicates a second correspondence that the discharge tray 420B corresponds to the supply tray 410B. With this configuration, the user can easily visually recognize each of the first correspondence and the second correspondence. That is, the user can easily grasp the correspondence between the supply trays and the discharge trays.

In particular, the supply trays 410A and 410B are arranged in the vertical direction 7 in the housing 200, and the discharge trays 420A and 420B are arranged in the vertical direction 7 in the housing 200. Further, the sheet 1A supported by the supply tray 410A is discharged from the discharge tray 420A through the conveyance path 440A. The sheet 1B supported by the supply tray 410B is discharged from the discharge tray 420B through the conveyance path 440B. By providing the first display 500, the correspondence of the trays can be displayed for the user so as to be easily understandable.

Each of the marks 500A to 500D is provided at the front surface 201. Thus, in a configuration where the supply trays 410A and 410B are removable from the housing 200, even if the supply tray 410A is mounted below the supply tray 410B, the first correspondence and the second correspondence are maintained. In a comparative example in which the marks 500C and 500D are provided at the front surface of the supply trays 410A and 410B and the supply trays 410A and 410B are removable from the housing 200, if the supply tray 410A is mounted below the supply tray 410B, the first and second correspondences are displayed incorrectly. Thus, it is advantageous for the user that each of the marks 500A to 500D is provided at the front surface 201, not at the removable trays.

[First Modification]

Figure 3:
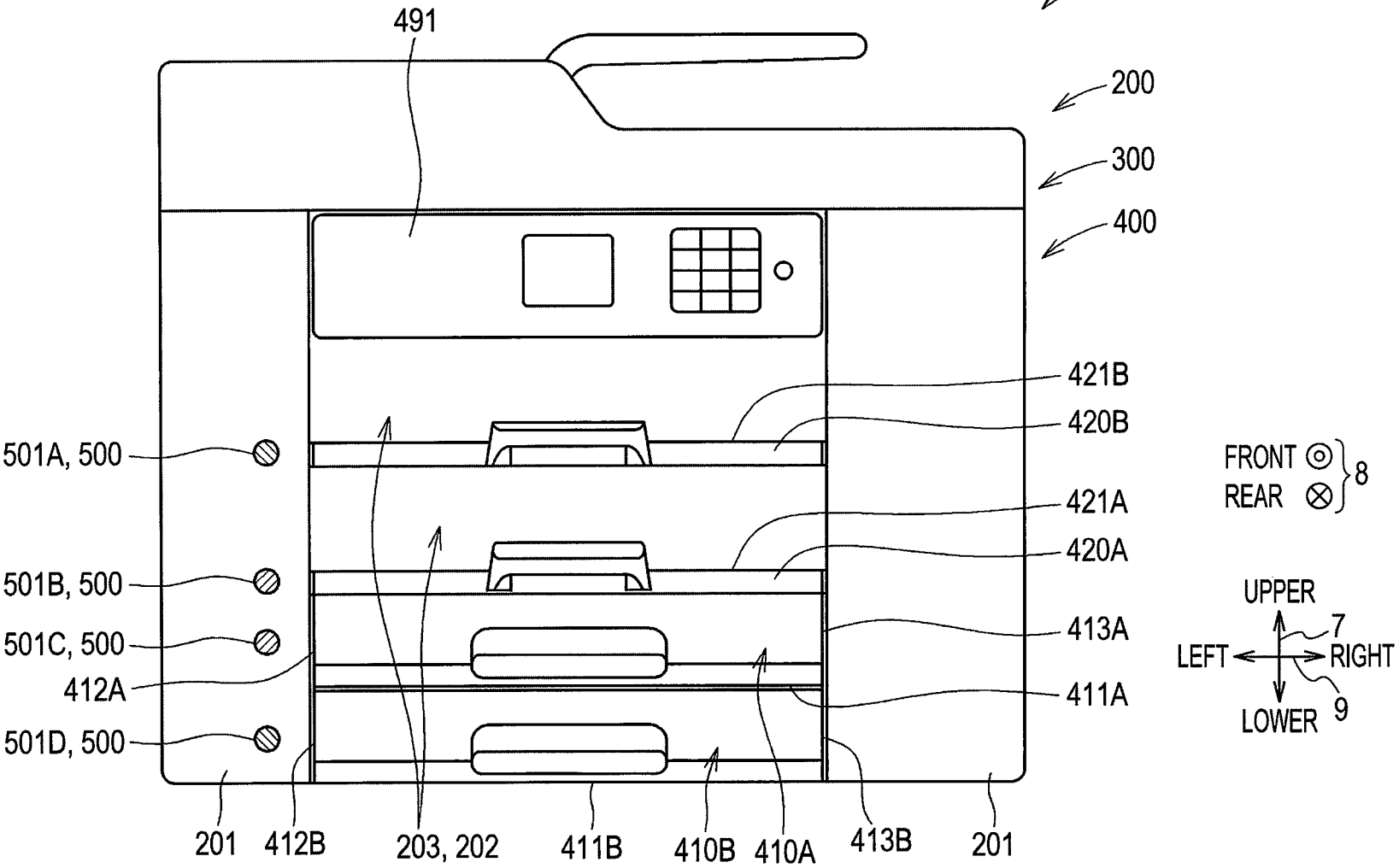
FIG. 3 is a front view schematically showing an MFP 100 according to a first modification.

In the embodiment, the first display 500 includes the marks 500A to 500D. However, as shown in FIG. 3, the first display 500 may include light emitting elements 501A to 501D in place of the marks 500A to 500D. Each of the light emitting elements 501A, 501D is an example of a second light emitting element. Each of the light emitting elements 501B, 501C is an example of a first light emitting element.

As shown in FIG. 3, the light emitting elements 501A to 501D are provided on a front surface 201 at positions corresponding to the positions where the marks 500A to 500D are provided.

Each of the light emitting elements 501A, 501D emits light of a first color (blue, for example) so as to indicate a second correspondence under the control of the controller 493. Each of the light emitting elements 501B, 501C emits light of a second color (yellow, for example) different from the first color so as to indicate a first correspondence under the control of the controller 493.

The first modification also allows the user to easily visually recognize each of the first correspondence and the second correspondence.

Figure 4:
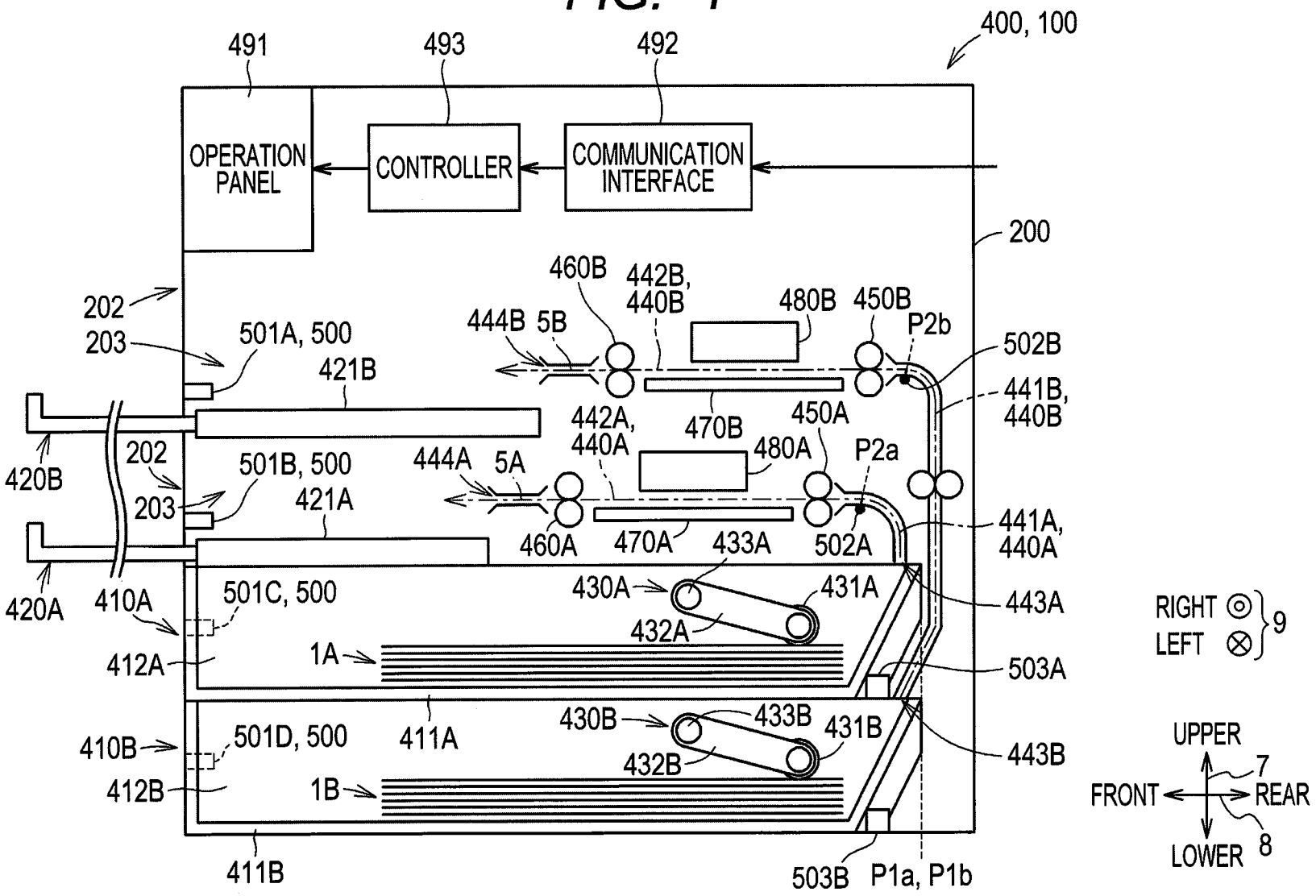
FIG. 4 is a vertical cross-sectional view schematically showing the internal structure of the MFP 100 of FIG. 3.

As shown in FIG. 4, a printer unit 400 further includes sheet sensors 502A, 502B and supply tray sensors 503A, 503B.

The sheet sensors 502A, 502B are respectively examples of an inner sheet sensor (first sheet sensor) and an outer sheet sensor (second sheet sensor). The supply tray sensors 503A, 503B are respectively examples of an upper tray sensor and a lower tray sensor.

The sheet sensor 502A is provided at the conveyance path 440A at a particular position P2*a* between the supply port 443A and the conveyance roller pair 450A. The sheet sensor 502A outputs a sheet signal S1*a* to the controller 493. When a sheet 1A is not located at the particular position P2*a*, the sheet signal S1*a* has a level higher than or equal to a sheet threshold value described later. When the sheet 1A is located at the particular position P2*a*, the sheet signal S1*a* has a level lower than the sheet threshold value.

The sheet sensor 502B is provided at the conveyance path 440B at a particular position P2*b* between the supply port 443B and the conveyance roller pair 450B, and slightly upstream of the conveyance roller pair 450B. The sheet sensor 502B outputs a sheet signal S1*b* to the controller 493. When a sheet 1B is not located at the particular position P2*b*, the sheet signal S1*b* has a level higher than or equal to the sheet threshold value described later. When the sheet 1B is located at the particular position P2*b*, the sheet signal S1*b* has a level lower than the sheet threshold value.

The supply tray sensors 503A, 503B are respectively provided in the vicinity of the rear ends of supply trays 410A, 410B which are located at mount positions P1*a*, P1*b*. The supply tray sensors 503A, 503B periodically output tray signals S2*a*, S2*b* to the controller 493. When the supply tray 410A is located at the mount position P1*a* the tray signals S2*a*, S2*b* have a level lower than a tray threshold value. When the supply tray 410A is not located at the mount position P1*a*, the tray signals S2*a*, S2*b* have a level higher than or equal to the tray threshold value.

Hereinafter, light emission control performed by the controller 493 will be described with reference to FIG. 5.

Figure 5:
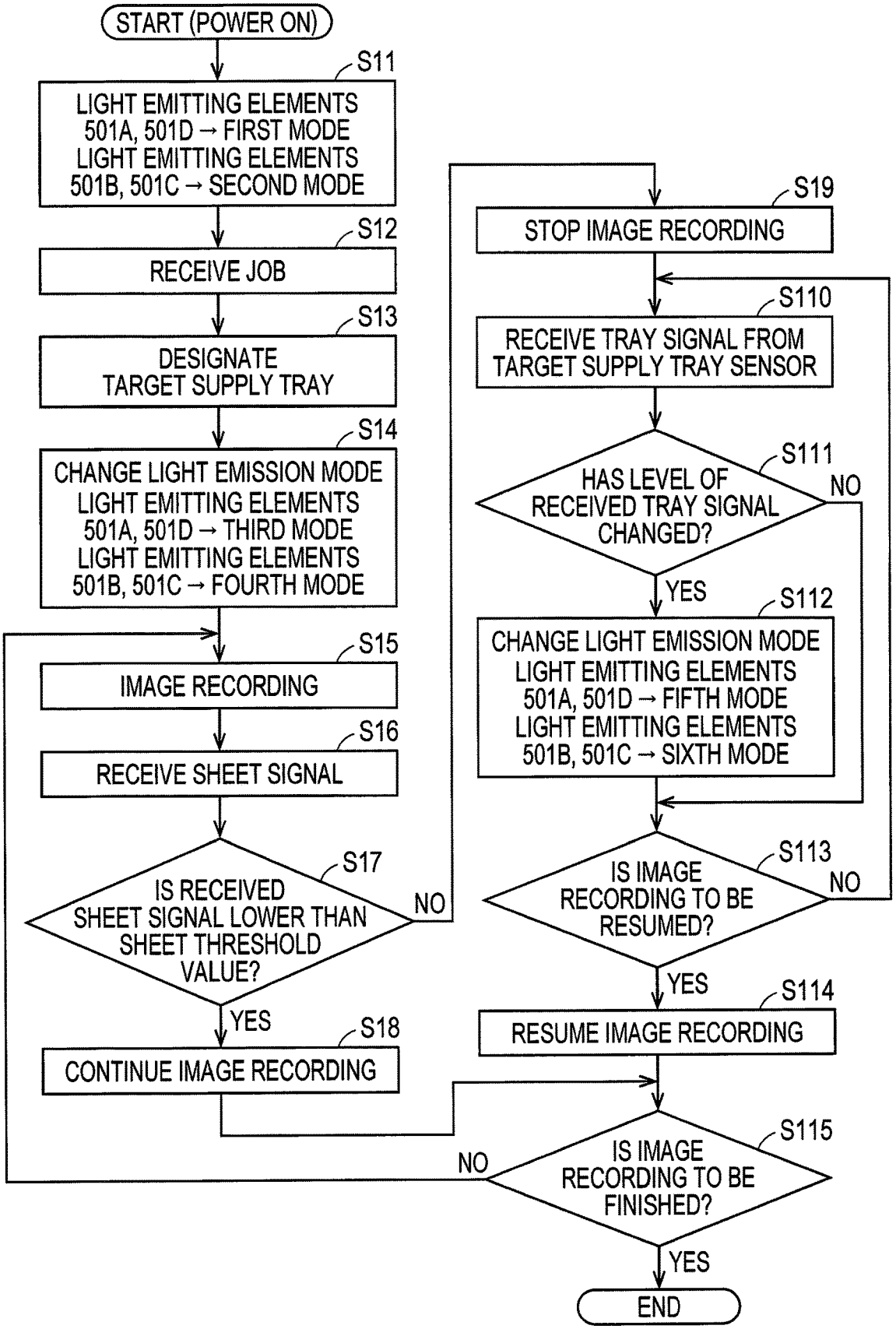
FIG. 5 is a flowchart of light emission control by a controller 493 of FIG. 4.

In FIG. 5, when the main power of the MFP 100 is turned on, in S11 the controller 493 controls each of the light emitting elements 501A, 501D to emit light of the first color in a first light emission mode, and controls each of the light emitting elements 501B, 501C to emit light of the second color in a second light emission mode. In other words, in response to not receiving a job through the communication interface 492, the controller 493 controls each of the light emitting elements 501A, 501D to emit light in the first light emission mode, and controls each of the light emitting elements 501B, 501C to emit light in the second light emission mode. The second color is a color different from the first color. The light in the first light emission mode and the light in the second light emission mode have a substantially constant amount of light regardless of the elapse of time.

In response to receiving a job in S12, in S13 the controller 493 designates at least the supply tray 410A or 410B as a target supply tray. For example, assume the case where the supply tray 410A holds A4 size sheets, and the supply tray 410B holds B5 size sheets. In such a case, when sheet information for a job indicates an A4 size sheet, the controller 493 selects the supply tray 410A. When the sheet information indicates a B5 size sheet, the controller 493 selects the supply tray 410B.

In S14, the controller 493 changes the light emission mode of the light emitting element corresponding to the target supply tray. That is, in a case where the target supply tray is the supply tray 410B, the controller 493 controls each of the light emitting elements 501A, 501D to emit light in a third light emission mode. In a case where the target supply tray is the supply tray 410A, the controller 493 controls each of the light emitting elements 501B, 501C to emit light in a fourth light emission mode. In the third light emission mode, the light emitting elements 501A, 501D emit light of the same color as the first light emission mode, and repeatedly turned on and off in a first cycle. In the fourth light emission mode, the light emitting elements 501B, 501C emit light of the same color as the second light emission mode, and repeatedly turned on and off in the first cycle.

In S15, the controller 493 performs image recording. In the image recording, the controller 493 controls respective portions of the printer unit 400 such that an image is recorded on a sheet in the target supply tray. The light emission mode of the light emitting element is changed and hence, the user can identify which discharge tray will discharge his/her own printed matter (that is, a sheet on which the image is recorded).

In S16, the controller 493 receives a sheet signal (that is, one of the sheet signals S1*a*, S1*b*) from the sheet sensor which corresponds to the target supply tray. In S17, the controller 493 determines whether the received sheet signal has become lower than the sheet threshold value within the elapse of a particular time period from the start of the rotation of a feed roller 431B (hereinafter also referred to as "particular period").

In response to determining that the sheet signal is lower than the sheet threshold value (S17: YES), the controller 493 continues the image recording (S18).

In response to determining that the sheet signal is higher than or equal to the sheet threshold value (S17: NO), the controller 493 determines that a jam has occurred, and stops the image recording (S19). More specifically, in a case where the target supply tray is the supply tray 410B, the sheet signal S1*b* is received. In a case where the sheet signal S1*b* has not become lower than the sheet threshold value within the particular period, it is considered that the sheet 1B has not arrived at the particular position P2*b* from the supply tray 410B. That is, it is considered that a malfunction (that is, a jam) has occurred in the conveyance path 440B. Similarly, in a case where the target supply tray is the supply tray 410A, when the sheet signal S1*a* has not become lower than the sheet threshold value within the particular period, it is considered that a malfunction (that is, a jam) has occurred in the conveyance path 440A.

After the image recording is stopped, the user starts removing the sheet jammed in the conveyance path.

After S19 is performed, in S110 the controller 493 receives a tray signal from the supply tray sensor corresponding to the supply tray where no jam has occurred (hereinafter also referred to as "target supply tray sensor"). In S111, the controller 493 determines whether the tray signal from the target supply tray sensor has changed to a level higher than or equal to the tray threshold value. In response to determining that the tray signal is changed to the level higher than or equal to the tray threshold value (S111: YES), the controller 493 performs S112. In response to determining that the tray signal has not changed to the level higher than or equal to the tray threshold value (S111: NO), the controller 493 performs S113.

In S112, the controller 493 changes the light emission mode of the light emitting element corresponding to the target supply tray. That is, in a case where the target supply tray is the supply tray 410B, the controller 493 controls each of the light emitting elements 501A, 501D to emit light in a fifth light emission mode. In a case where the target supply tray is the supply tray 410A, the controller 493 controls each of the light emitting elements 501B, 501C to emit light in a sixth light emission mode. In the fifth light emission mode, the light emitting elements 501A, 501D emit light of the same color as the first light emission mode, and repeatedly turned on and off in a second cycle. In the sixth light emission mode, the light emitting elements 501B, 501C emit light of the same color as the second light emission mode, and repeatedly turned on and off in the second cycle. The second cycle is shorter than the first cycle. With such a configuration, the MFP 100 notifies the user that a wrong supply tray is pulled out.

In S113, the controller 493 determines whether to resume the image recording. In S113, the controller 493 determines whether to resume the image recording based on whether the user has completed removal of a sheet and performed a particular operation on the operation panel 491, for example. In response to determining that the image recording is to be resumed (S113: YES), the controller 493 resumes the image recording (S114). In response to determining that the image recording is not to be resumed (S113: NO), the controller 493 performs S110.

After S18 or S114 is performed, in S115 the controller 493 determines whether to finish the image recording. In response to determining that the image recording is not to be finished (S115: NO), the controller 493 performs S15 to continue the image recording. In response to determining that the image recording is to be finished (S115: YES), the controller 493 ends the processing shown in FIG. 5.

Due to the above-mentioned positional relationship and color correspondence, the combination of the light emitting elements 501B, 501C indicates the first correspondence where the discharge tray 420A corresponds to the supply tray 410A. The combination of the light emitting elements 501A, 501D indicates the second correspondence where the discharge tray 420B corresponds to the supply tray 410B. Such a configuration allows the user to easily visually recognize each of the first correspondence and the second correspondence.

The light emitting elements 501A to 501D emit light in various modes under the control of the controller 493 and hence, it is possible to notify the user of not only the first correspondence and the second correspondence, but also the occurrence of a jam or to which discharge tray a printed matter is discharged.

[Second Modification]

Figure 6:
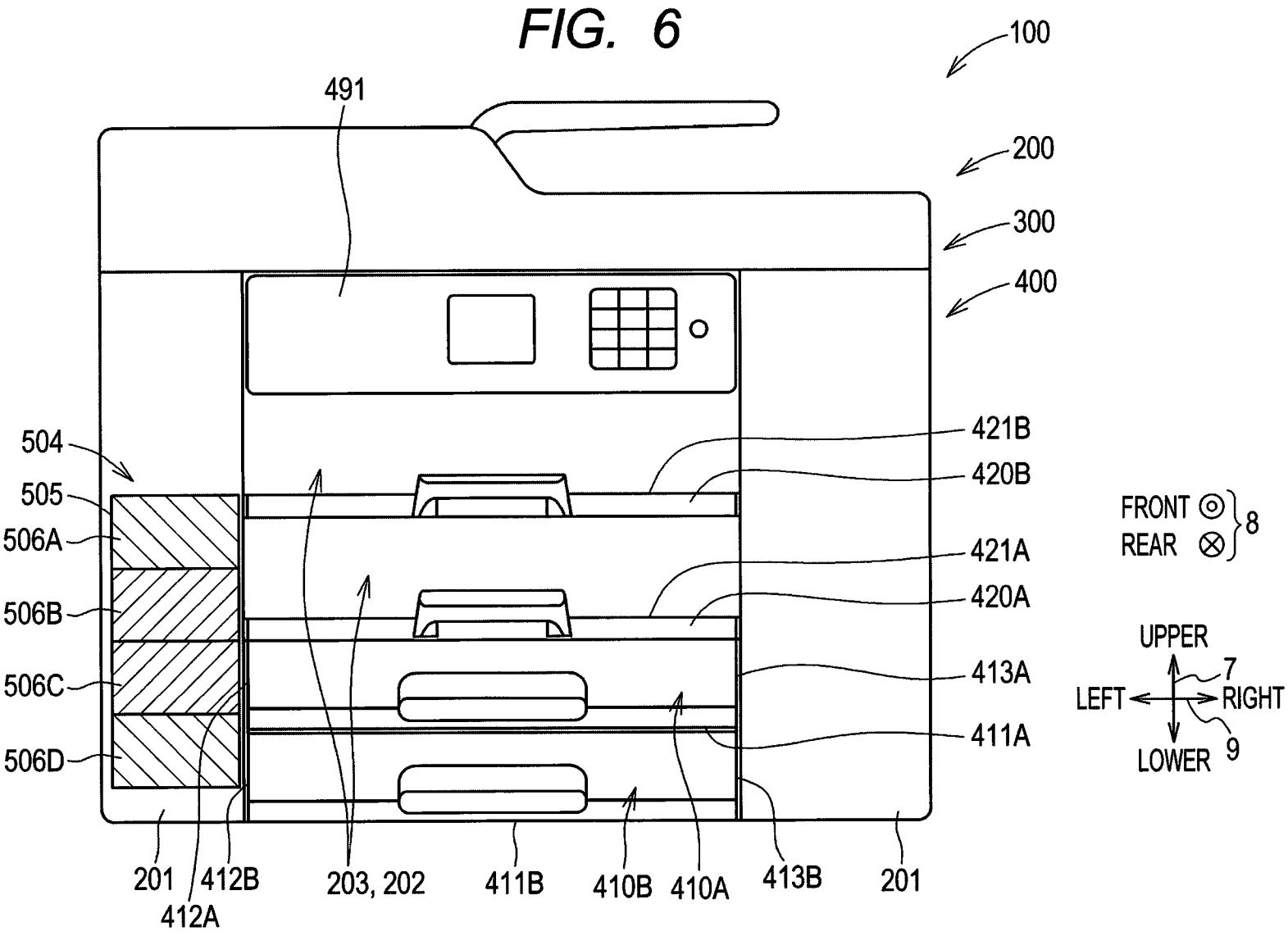
FIG. 6 is a front view schematically showing an MFP 100 according to a second modification.
Figure 7:
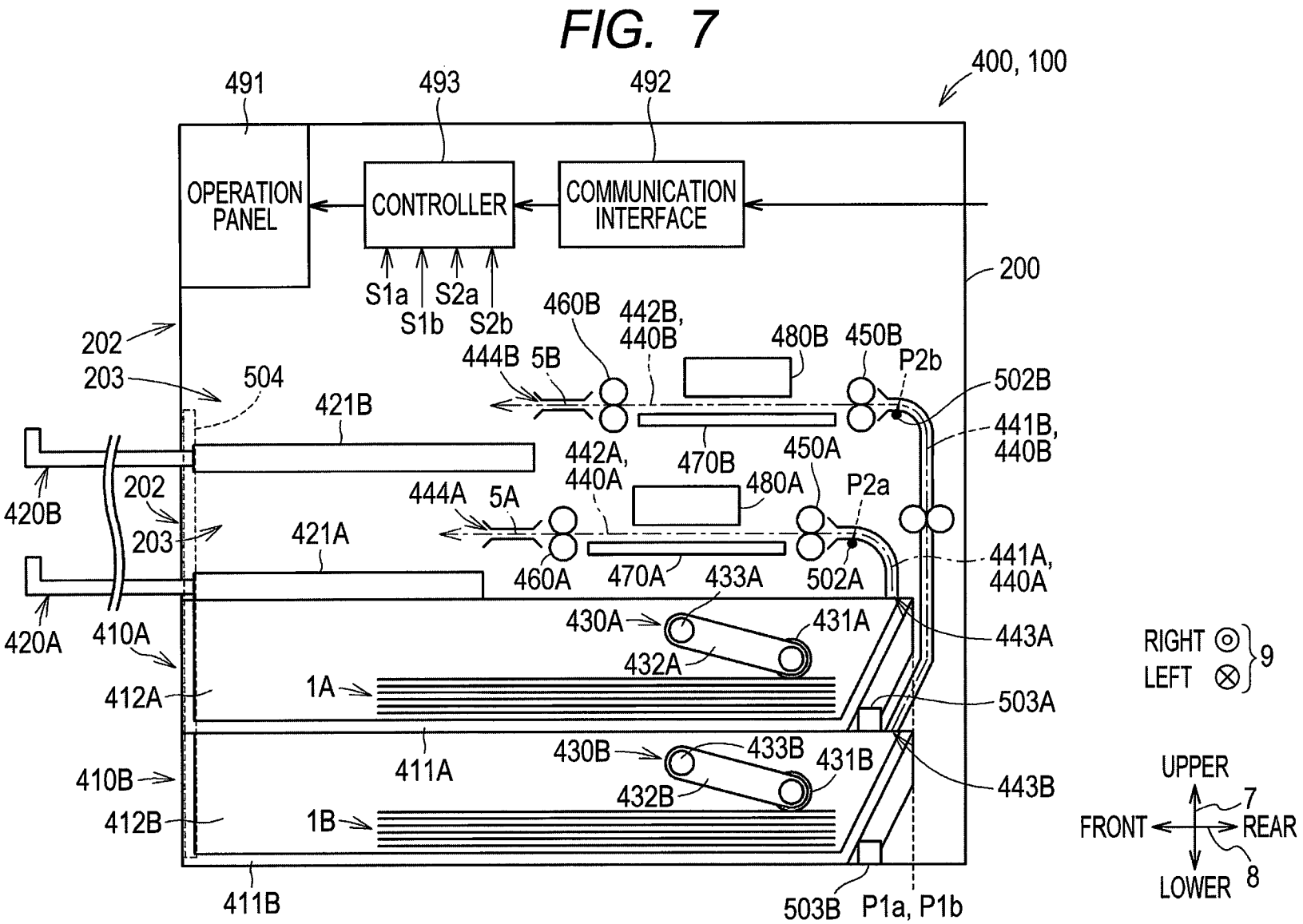
FIG. 7 is a vertical cross-sectional view schematically showing the internal structure of the MFP 100 of FIG. 6.

In the first modification, the first display 500 includes the light emitting elements 501A to 501D. However, as shown in FIG. 6, the first display 500 may be a display device 504 (such as an LCD display) provided at the front surface 201 of the housing 200 at a position at a side (the left side, for example) of the supply trays 410A, 410B and the discharge trays 420A, 420B. In FIG. 7, the controller 493 generates image data, and transmits the image data to the display device 504. The display device 504 displays an image 505 (see FIGS. 9A to 9E) based on the image data. The image 505 contains first image objects 506A, 506D and second image objects 506B, 506C.

The first image object 506A of the image 505 is located on the front surface 201 at a position at the left side of the discharge tray 420B (an example of a position laterally shifted from the discharge tray 420B), and the first image object 506D of the image 505 is located on the front surface 201 at a position at the left side of the supply tray 410B. The first image objects 506A, 506D indicate the second correspondence.

The second image object 506B is located on the front surface 201 at a position at the left side of the discharge tray 420A, and the second image object 506C is located on the front surface 201 at a position at the left side of the supply tray 410A. The second image objects 506B, 506C indicate the first correspondence.

Hereinafter, display control performed by the controller 493 will be described with reference to FIG. 8.

Figure 8:
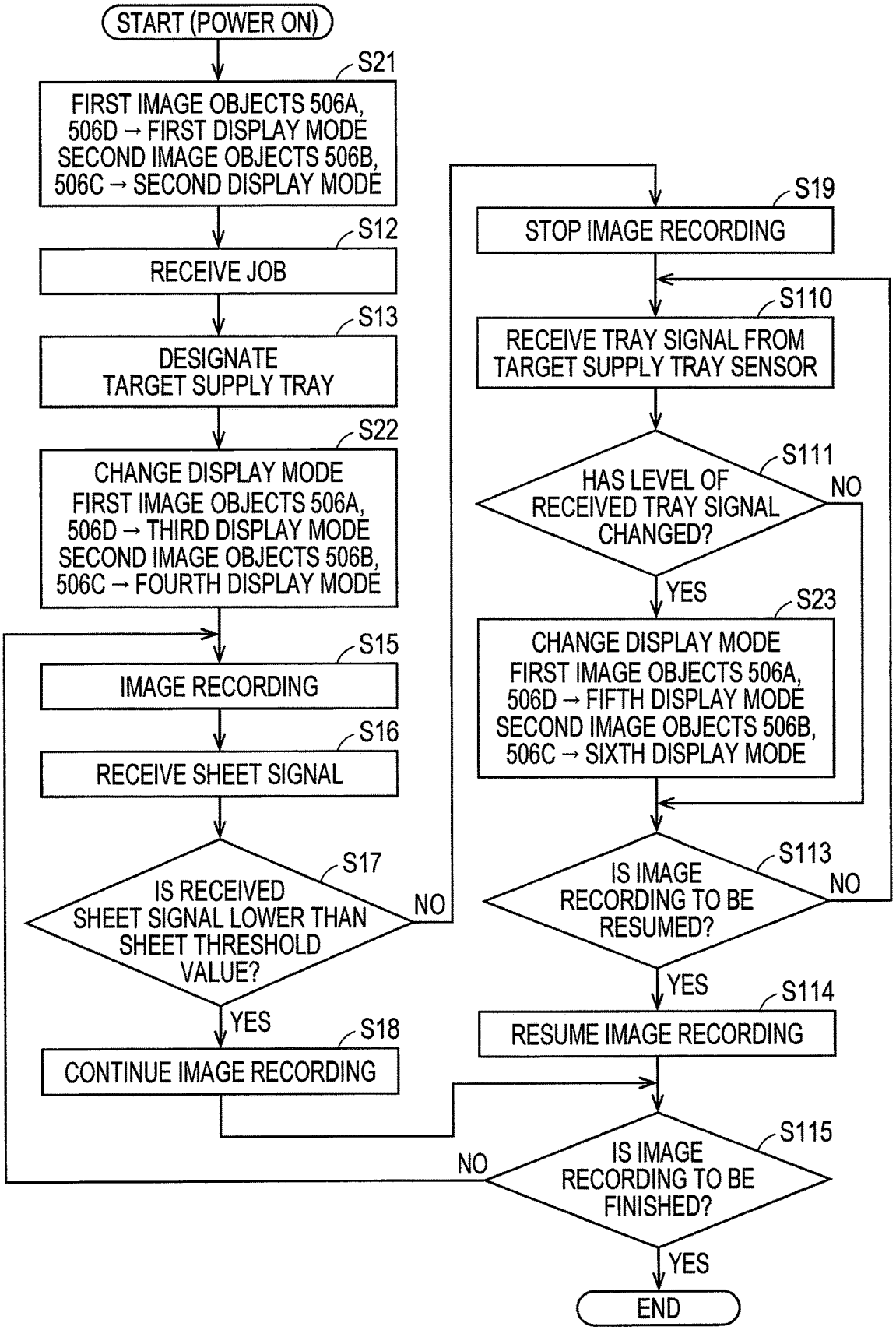
FIG. 8 is a flowchart of display control by a controller 493 of FIG. 7.

FIG. 8 differs from FIG. 5 in that FIG. 8 includes S21, S22, and S23 in place of S11, S14, and S112. There is no other difference between both flowcharts other than the above and hence, steps in FIG. 8 which correspond to respective steps shown in FIG. 5 are given the same step numbers, and the repeated description of the respective steps will be omitted.

Figure 9A:
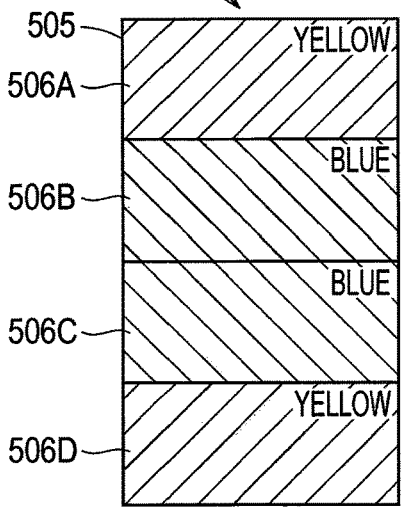
FIGS. 9A to 9E are schematic views showing images 505 in various display modes.

In FIG. 8, when the main power of the MFP 100 is turned on, in S21 the controller 493 generates image data, and transmits the image data to the display device 504. The display device 504 displays the image 505 based on the image data. As shown in FIG. 9A, the image 505 contains the first image objects 506A, 506D having a first display mode and the second image objects 506B, 506C having a second display mode. The first image objects 506A, 506D in the first display mode are image objects having the same outline and color (yellow, for example). The second image objects 506B, 506C in the second display mode have the same outline and color (blue, for example).

Figure 9B:
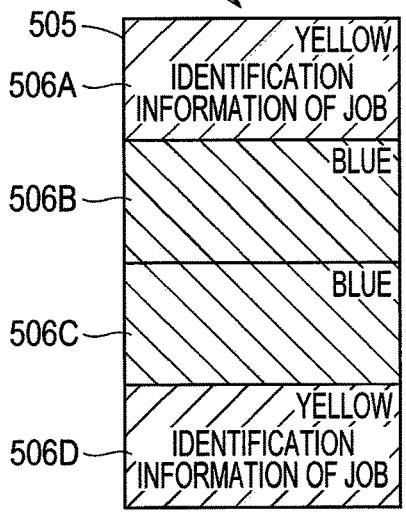
Figure 9C:
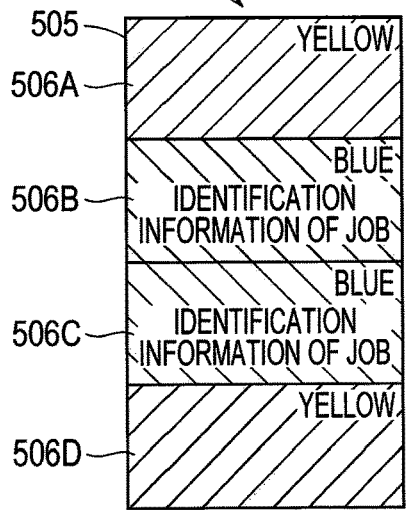

In S22, the controller 493 changes image data to be transmitted to the display device 504. More specifically, the controller 493 changes an image object which corresponds to the target supply tray. That is, in a case where the target supply tray is the supply tray 410B, as shown in FIG. 9B, the controller 493 generates image data indicating an image 505 which contains the first image objects 506A, 506D having a third display mode, and transmits the image data to the display device 504. In a case where the target supply tray is the supply tray 410A, as shown in FIG. 9C, the controller 493 generates image data indicating an image 505 which contains the second image objects 506B, 506C having a fourth display mode, and transmits the image data to the display device 504. The first image objects 506A, 506D in the third display mode and the second image objects 506B, 506C in the fourth display mode differ from the first image objects 506A, 506D in the first display mode and the second image objects 506B, 506C in the second display mode in that the first image objects 506A, 506D in the third display mode and the second image objects 506B, 506C in the fourth display mode contain job identification information, such as a file name, for example. Such a configuration allows the user to identify which discharge tray will discharge his/her own printed matter (that is, a sheet on which an image is recorded).

Figure 9D:
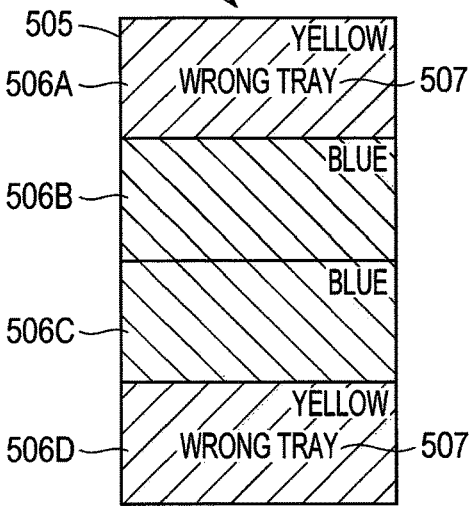
Figure 9E:
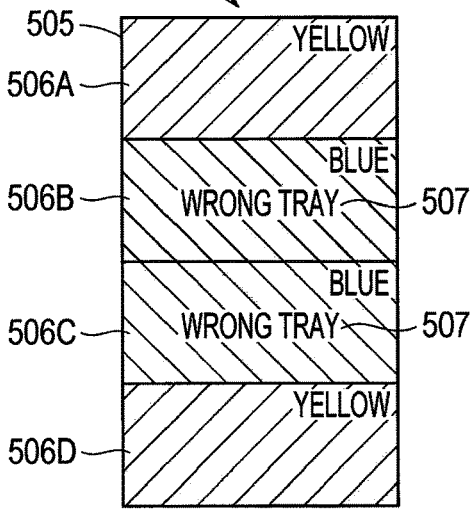

In S23, the controller 493 changes image data to be transmitted to the display device 504. More specifically, the controller 493 changes an image object which corresponds to the target supply tray. That is, in a case where the target supply tray is the supply tray 410B, as shown in FIG. 9D, the controller 493 generates image data indicating an image 505 which contains the first image objects 506A, 506D having a fifth display mode, and transmits the image data to the display device 504. In a case where the target supply tray is the supply tray 410A, as shown in FIG. 9E, the controller 493 generates image data indicating an image 505 which contains the second image objects 506B, 506C having a sixth display mode, and transmits the image data to the display device 504. The first image objects 506A, 506D in the fifth display mode and the second image objects 506B, 506C in the sixth display mode differ from the first image objects 506A, 506D in the first display mode and the second image objects 506B, 506C in the second display mode in that the first image objects 506A, 506D in the fifth display mode and the second image objects 506B, 506C in the sixth display mode contain an object 507 indicating that the user has pulled out a wrong supply tray, for example. With such a configuration, the MFP 100 notifies the user that a wrong supply tray is pulled out.

[Third Modification]

Next, a third modification will be described with reference to FIGS.

10A and 10B.

Figure 10B:
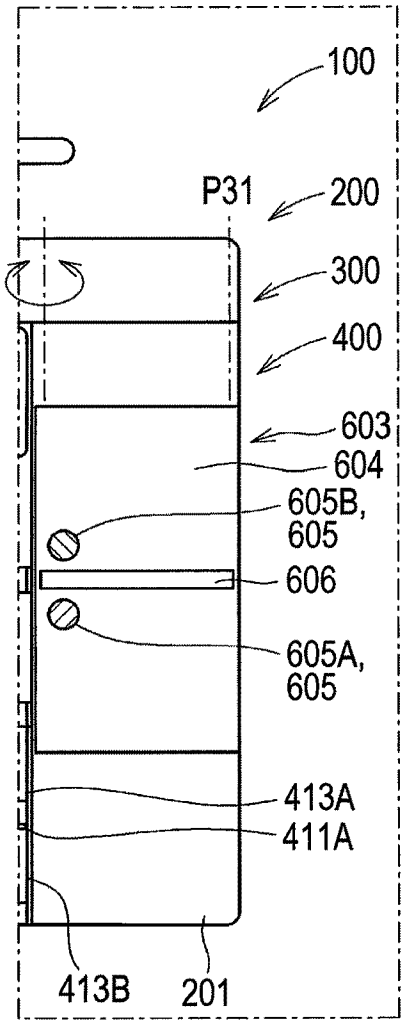
FIGS. 10A and 10B are schematic views showing the configuration of an MFP 100 according to a third modification.
Figure 10A:
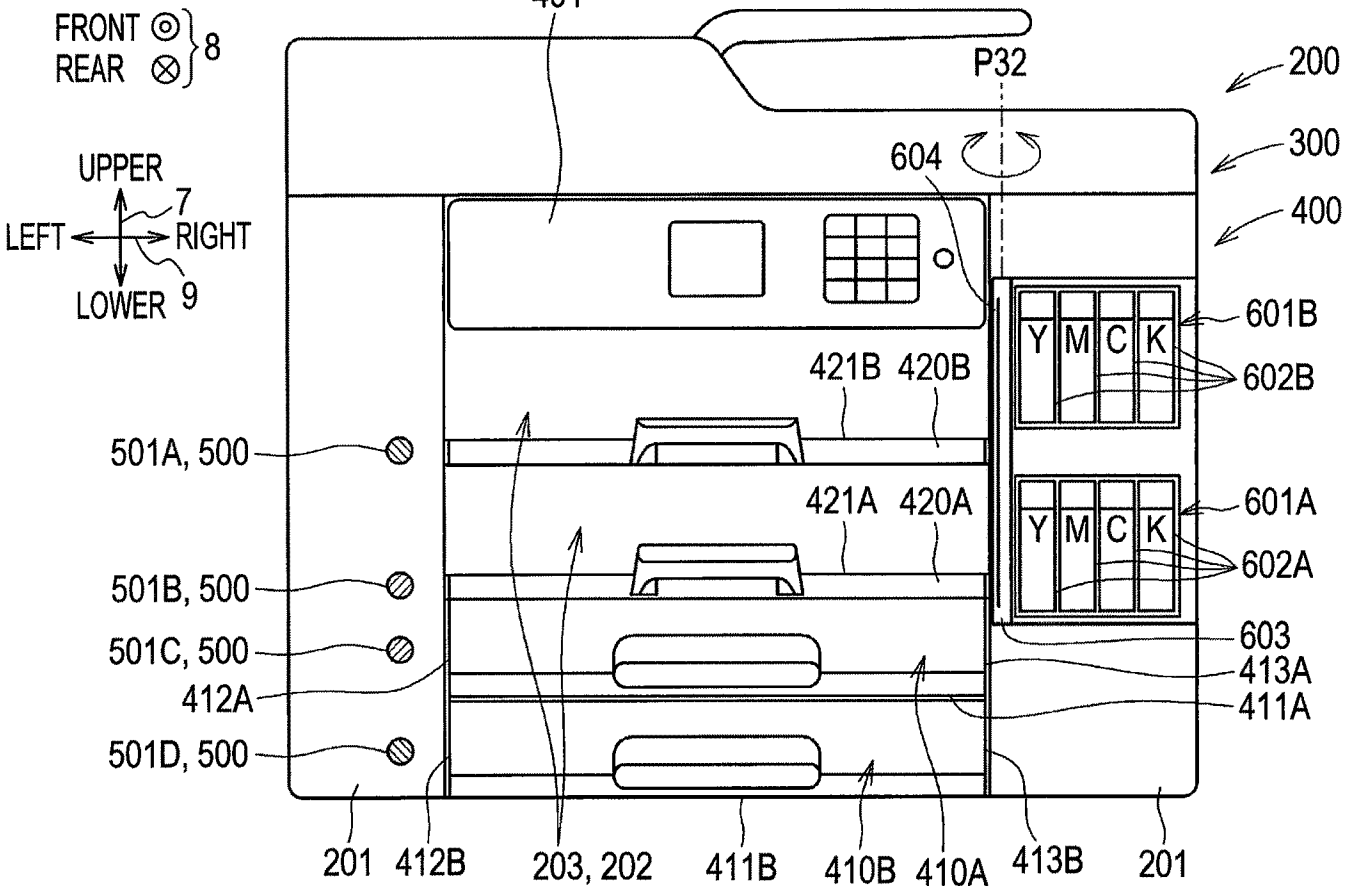

In FIG. 10A, the front surface 201 of the housing 200 has housing spaces 601A, 601B at the right side of the opening 202. Each of the housing spaces 601A, 601B opens toward the front. The housing space 601A is formed at a position lower than the discharge tray 420B in the vertical direction 7, and the housing space 601B is formed at a position higher than the discharge tray 420B in the vertical direction 7.

The printer unit 400 further includes containers 602A, 602B and a cover 603.

The containers 602A are housed in the housing space 601A, and the containers 602B are housed in the housing space 601B, respectively. Each container 602A has an ink storage chamber which is in fluid communication with the recording head 480A through an ink tube. Each container 602A stores ink to be supplied to the recording head 480A in the ink storage chamber. Each container 602B has an ink storage chamber which is in fluid communication with the recording head 480B through an ink tube. Each container 602B stores ink to be supplied to the recording head 480B in the ink storage chamber. In other words, the containers 602A have a third correspondence which corresponds to the supply tray 410A, the conveyance path 440A, the recording head 480A, and the discharge tray 420A. The containers 602B have a fourth correspondence which corresponds to the supply tray 410B, the conveyance path 440B, the recording head 480B, and the discharge tray 420B.

The containers 602A, 602B are respectively examples of a first reservoir and a second reservoir. The containers 602A, 602B may be tanks which are installed in the housing spaces 601A, 601B, or may be cartridges which are attachable to or detachable from the housing spaces 601A, 601B.

The cover 603 is supported by the housing 200 so as to be movable between a closed position P31 and an open position P32 about an axis extending along the vertical direction 7. As shown in FIG. 10B, the closed position P31 is a position where the cover 603 faces the containers 602A, 602B in the housing spaces 601A, 601B of the housing 200 to enclose the containers 602A, 602B in the housing 200. As shown in FIG. 10A, the open position P32 is a position where the cover 603 is rotatably moved about the axis from the closed position P31 to expose the containers 602A, 602B in the housing spaces 601A, 601B to the outside.

The cover 603 includes a second display 605 on a front surface 604. The second display 605 includes marks 605A, 605B. The marks 605A, 605B are respectively examples of a third mark and a fourth mark.

The mark 605A is located on the front surface 604 at a position closer to the container 602A than to the container 602B. The mark 605A is located at a position higher than the discharge tray 420A in the vertical direction 7, and closer to the discharge tray 420A than to the discharge tray 420B.

The mark 605B is located on the front surface 604 at a position closer to the container 602B than to the container 602A. The mark 605B is located at a position at the right side of the discharge tray 420B, and closer to the discharge tray 420B than to the discharge tray 420A in the vertical direction 7.

Each of the marks 605A, 605B is obtained by coloring the inside of the same outline with paint. The mark 605A has the same color as the marks 501B and 501C, and the mark 605B has the same color as the marks 501A and 501D (see FIGS. 10A, 10B). With such a configuration, the mark 605A indicates a correspondence between the containers 602A and at least the supply tray 410A, the conveyance path 440A, the recording head 480A, or the discharge tray 420A. The mark 605B indicates a correspondence between the containers 602B and at least the supply tray 410B, the conveyance path 440B, the recording head 480B, or the discharge tray 420B. That is, the mark 605A displays the third correspondence in the same mode as the first correspondence, and the mark 605B displays the fourth correspondence in the same mode as the second correspondence. As a result, the user can easily visually recognize each of the third correspondence and the fourth correspondence.

Figure 14A:
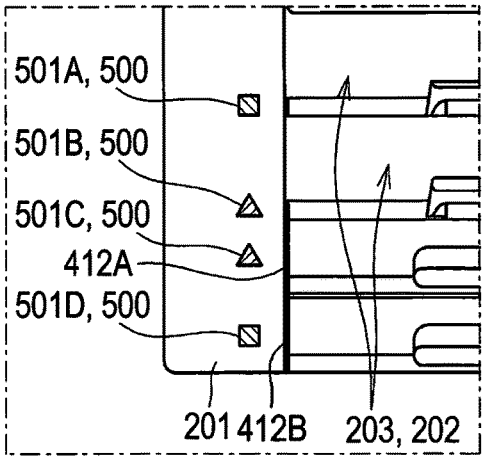
Figure 14D:
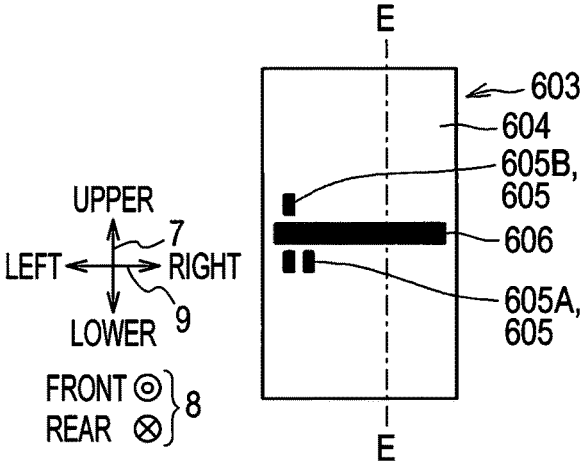
Figure 14B:
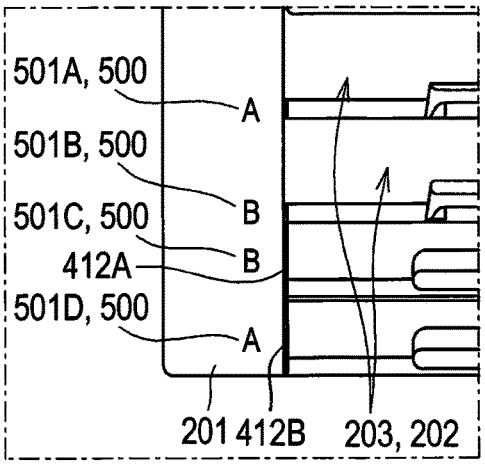
Figure 14E:
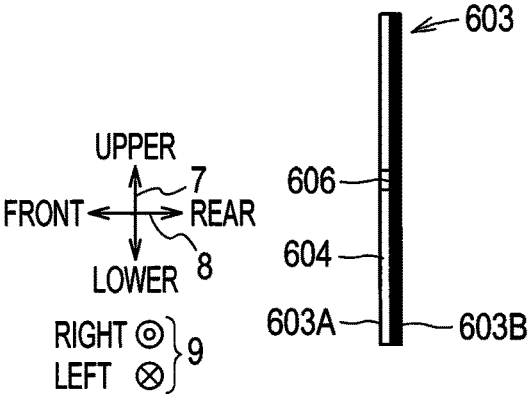

As shown in FIG. 14D and FIG. 14E, the cover 603 may include an outer cover member 603A and an inner cover member 603B which have different colors. FIG. 14E is a cross-sectional view showing the vertical cross section of the cover 603 taken along the single-dot chain line E-E in FIG. 14D as viewed from the right side. The outer cover member 603A covers the front surface of the inner cover member 603B, and is attached to the inner cover member 603B. In this case, the marks 605A, 605B may be formed by slits formed on the outer cover member 603A.

The second display 605 includes a mark 606, which linearly extends in a lateral direction, on the front surface 604 of the cover 603. The mark 606 is one example of a linear mark.

The mark 606 is located at a position between the containers 602A and 602B in the vertical direction 7. The mark 606 is a mark having the same color as the marks 605A, 605B. With such a configuration, even in a case where the cover 603 is in the closed position P31 and the containers 602A, 602B are not visually recognized from the outside, the user can infer that two sets of containers 602A, 602B are present in the housing 200.

The mark 606 is not limited to the mark colored with paint, and may be a groove-like recessed portion linearly extending in the lateral direction. Further, in a case where the cover 603 has the outer cover member 603A and the inner cover member 603B as shown in FIG. 14D, the mark 606 may be a slit formed on the outer cover member 603A.

[Fourth Modification]

Next, a fourth modification will be described with reference to FIGS. 11A and 11B.

Figure 11B:
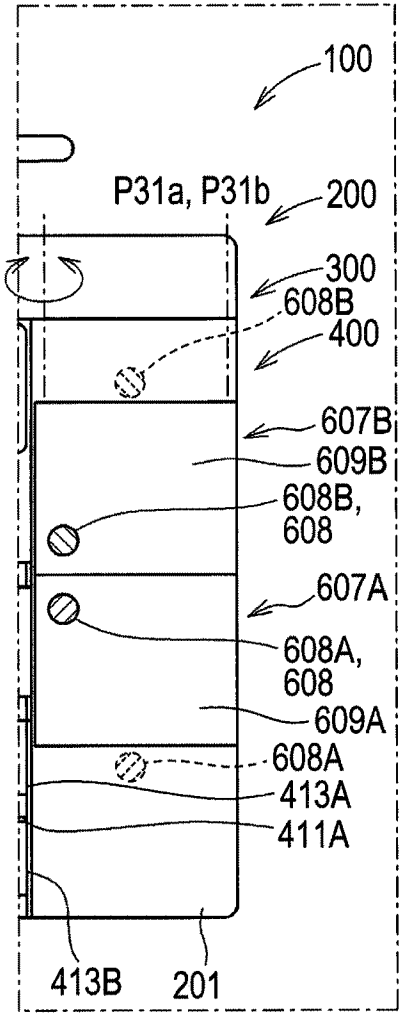
FIGS. 11A and 11B are schematic views showing the configuration of an MFP 100 according to a fourth modification.
Figure 11A:
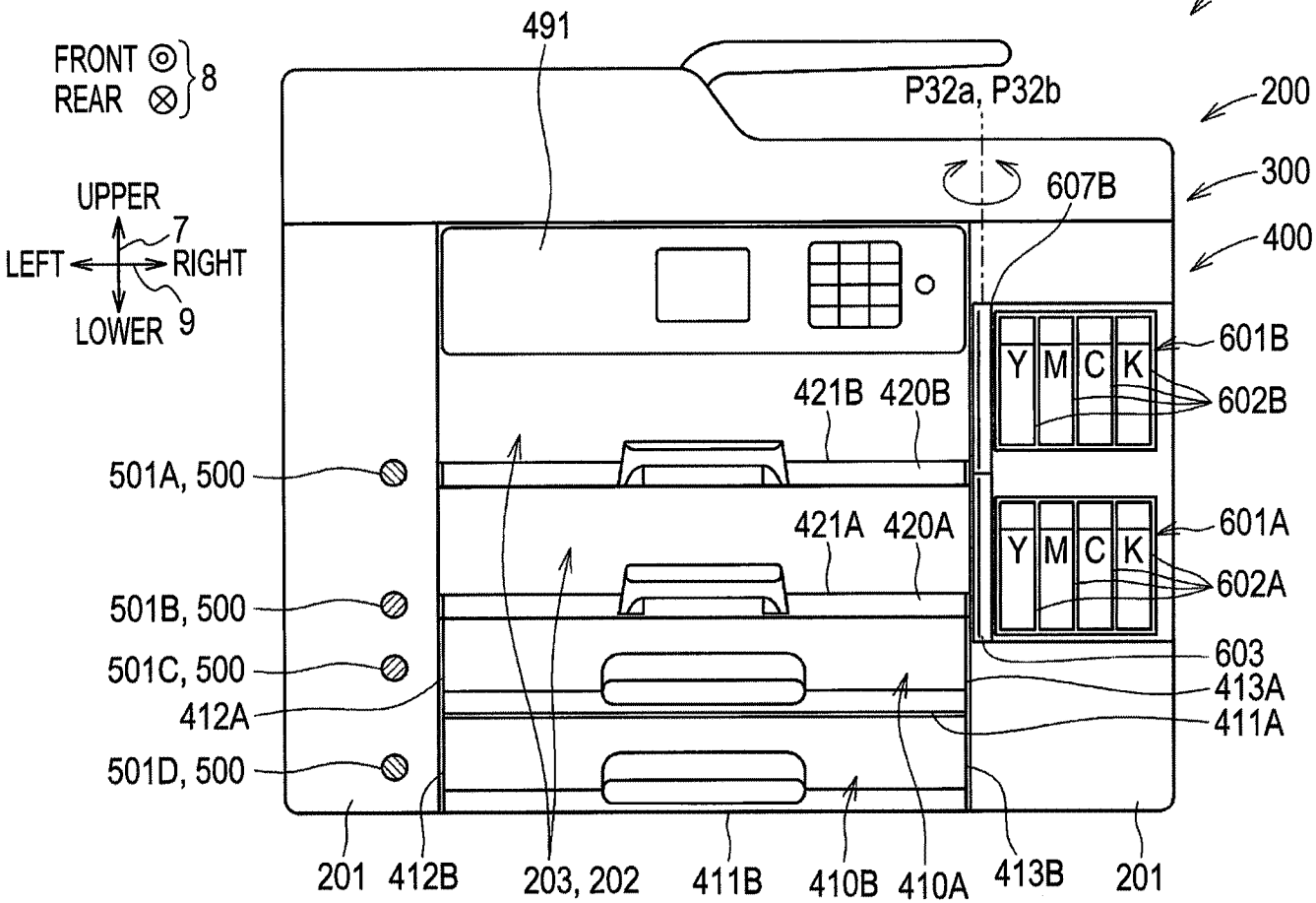

The printer unit 400 shown in FIGS. 11A and 11B differs from the printer unit 400 of the third modification in that the printer unit 400 of this modification includes covers 607A, 607B and a second display 608 in place of the cover 603 and the second display 605. Other configurations of the printer unit 400 of this modification are substantially the same as the corresponding configurations of the printer unit 400 of the third modification. Therefore, the covers 607A, 607B and the second display 608 will be described hereinafter. The covers 607A, 607B are respectively examples of a first cover and a second cover.

The cover 607A is supported by the housing 200 so as to be movable between a closed position P31*a* and an open position P32*a* about the axis extending along the vertical direction 7. As shown in FIG. 11B, the closed position P31*a* is a position where the cover 607A faces the containers 602A in the housing space 601A of the housing 200 to enclose the containers 602A in the housing 200. As shown in FIG. 11A, the open position P32*a* is a position where the cover 607A is rotatably moved about the axis from the closed position P31*a* to expose the containers 602A in the housing space 601A to the outside.

The cover 607B is located at a position immediately above the cover 607A, and is supported by the housing 200 so as to be movable between a closed position P3 lb and an open position P32*b* about the axis extending along the vertical direction 7. As shown in FIG. 11B, the closed position P3 lb is a position where the cover 607B faces the containers 602B in the housing space 601B of the housing 200 to enclose the containers 602B in the housing 200. As shown in FIG. 11A, the open position P32*b* is a position where the cover 607B is rotatably moved about the axis from the closed position P31*b* to expose the containers 602B in the housing space 601B to the outside.

The second display 608 includes marks 608A, 608B. The marks 608A, 608B are respectively examples of a third mark and a fourth mark.

The marks 608A, 608B are substantially the same as the marks 605A, 605B except for the following points. The mark 608A is located on a front surface 609A of the cover 607A at a position closer to the container 602A than to the container 602B. The mark 608B is located on a front surface 609B of the cover 607B at a position closer to the container 602B than to the container 602A. Such marks 608A, 608B allow the user to easily visually recognize each of the third correspondence and the fourth correspondence. Alternatively, as shown in the dotted lines in FIG. 11B, the marks 608A, 608B may be provided on the front surface 201 of the housing 200, not on the cover.

[Fifth Modification]

Next, a fifth modification will be described with reference to FIGS. 12A and 12B.

Figure 12A:
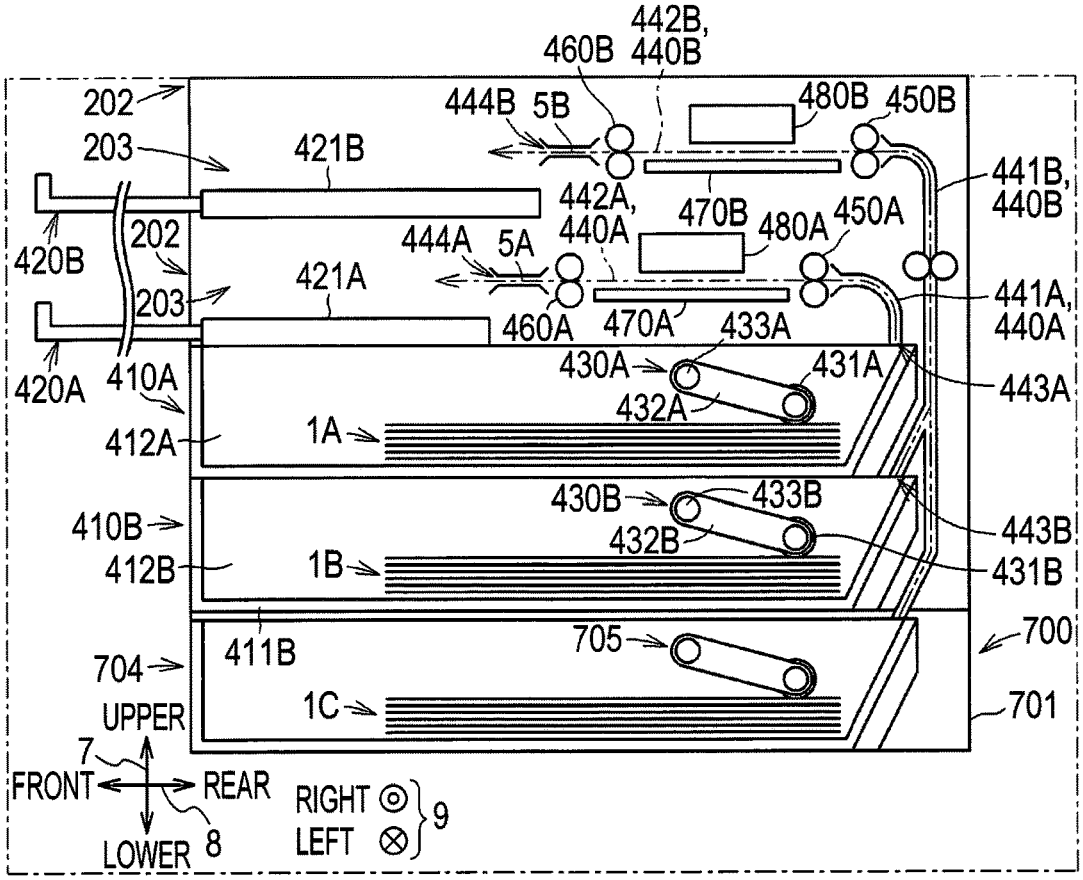
FIGS. 12A and 12B are schematic views showing the configuration of an MFP 100 according to a fifth modification.
Figure 12B:
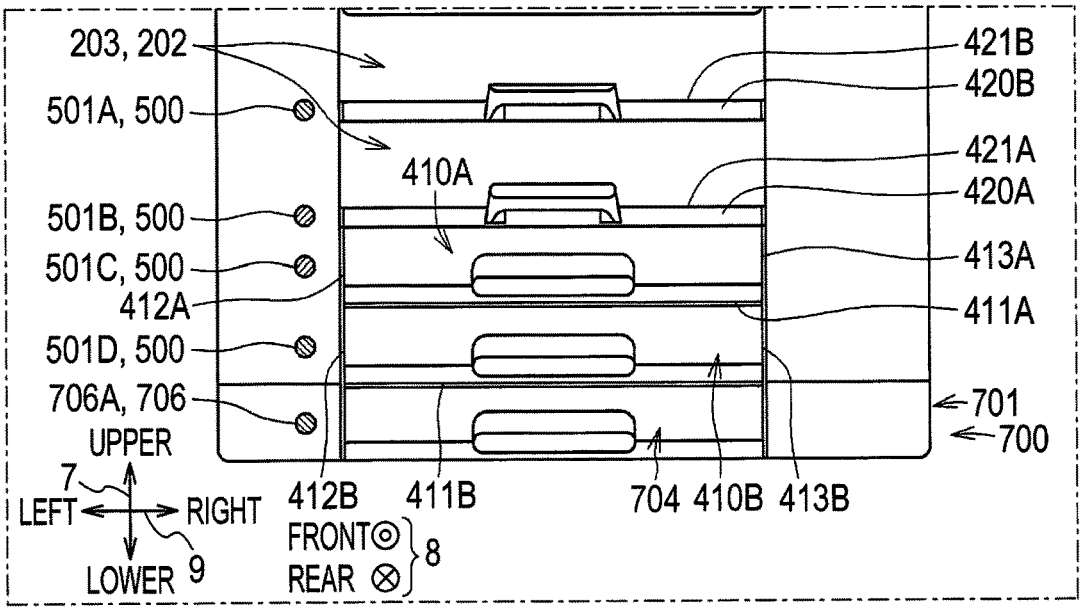

As shown in FIGS. 12A and 12B, the printer unit 400 of this modification differs from the printer unit 400 of the embodiment in that the printer unit 400 of this modification further includes an additional tray unit 700 at a position below the housing 200.

The additional tray unit 700 includes an additional supply tray 704 and an additional feed mechanism 705 in a housing 701. The additional supply tray 704 and the additional feed mechanism 705 may have configurations substantially the same as the configurations of the supply tray 410A and the feed mechanism 430A and hence, the detailed description of the additional supply tray 704 and the additional feed mechanism 705 will be omitted. A sheet 1C held by the additional supply tray 704 is fed by the additional feed mechanism 705, and is guided to the conveyance path 440B. That is, the additional supply tray 704 corresponds to the conveyance path 440B, the recording head 480B, and the discharge tray 420B, and has a fifth correspondence with respect to these components.

The additional tray unit 700 includes a third display 706 on the front surface of the housing 701. The third display 706 includes a mark 706A. The mark 706A is a mark obtained by coloring the inside of the outline, which is the same as the outline of each of the marks 500A to 500D, with paint, and the mark 706A has the same color as the marks 501A, 501D (see FIG. 12B). Such a configuration allows the user to easily visually recognize the fifth correspondence.

[Sixth Modification]

Next, a sixth modification will be described with reference to FIG. 13. The printer unit 400 shown in FIG. 13 differs from the printer unit 400 shown in FIG. 1 in that the printer unit 400 of this modification further includes reverse roller pairs 810A, 810B, flaps 820A, 820B, and reverse conveyance paths 830A, 830B.

[Reverse Roller Pairs 810A, 810B]

Figure 13:
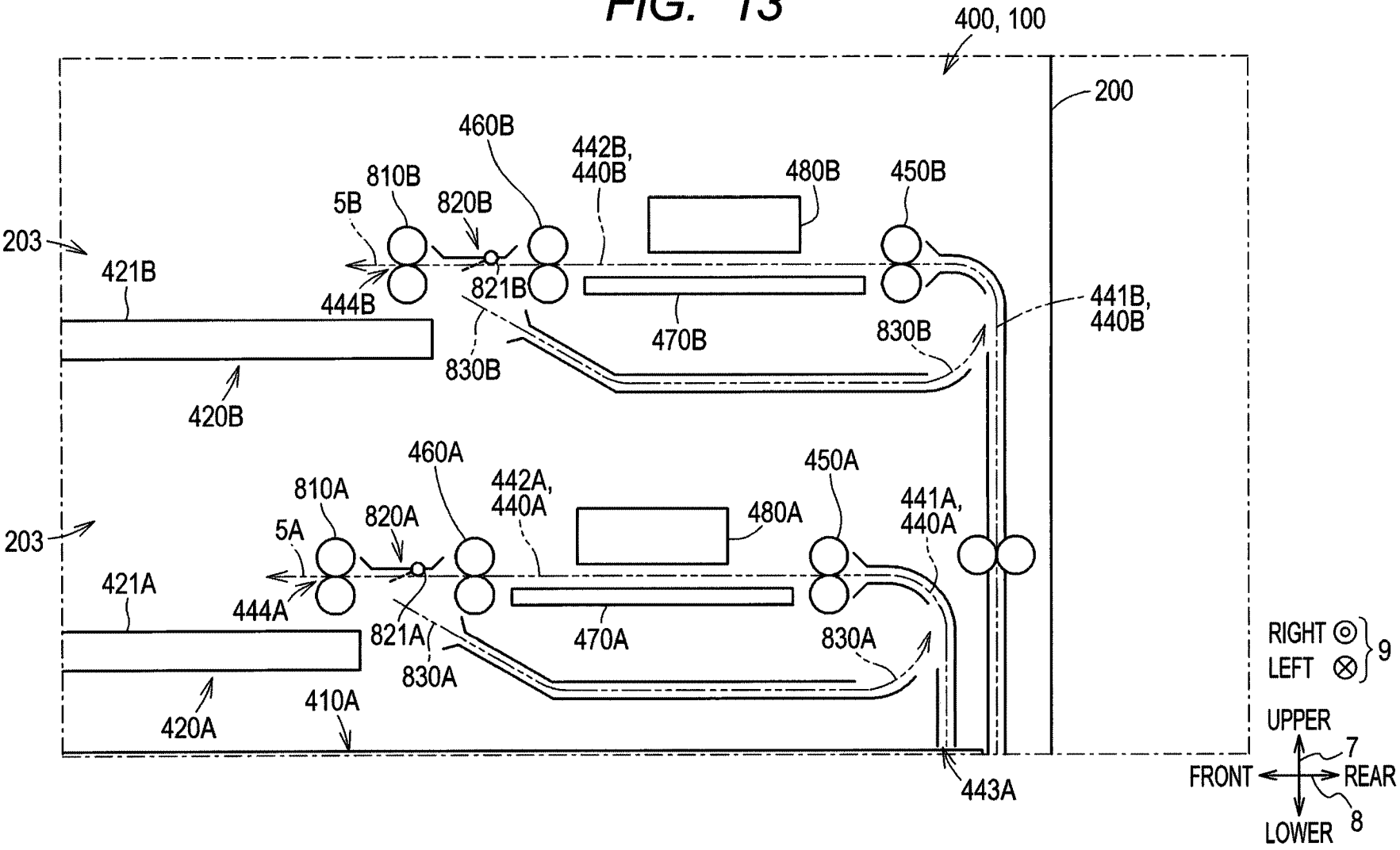
FIG. 13 is a schematic view showing the configuration of an MFP 100 according to a sixth modification.

As shown in FIG. 13, the reverse roller pair 810A includes two rollers in contact with each other at a position downstream of a discharge roller pair 460A and immediately upstream of a discharge port 444A on a straight portion 442A of the conveyance path 440A. One of the two rollers extends in the left-right direction 9 along the straight portion 442A at a position below the straight portion 442A. The one of the two rollers rotates in a forward direction and a direction opposite to the forward direction by a driving force generated by the conveyance motor (not shown). The other of the two rollers is a spur and so on. The other of the two rollers contacts the one roller from above, and is rotated by following the rotation of the one roller. The sheet 1A (see FIG. 2) is conveyed in the conveyance direction 5A in a state of being nipped by the one roller rotating in the forward direction and the other roller driven to rotate. Further, the sheet 1A is conveyed in the direction opposite to the conveyance direction 5A by the one roller rotating in the opposite direction and the other roller driven to rotate.

The reverse roller pair 810B is substantially the same as the reverse roller pair 810A except for that the reverse roller pair 810B is disposed at the straight portion 442B of the conveyance path 440B at a position downstream of a discharge roller pair 460B and immediately upstream of a discharge port 444B. Therefore, the detailed description of the reverse roller pair 810B will be omitted.

[Flaps 820A and 820B, Reverse Conveyance Paths 830A and 830B]

The flap 820A is located at the straight portion 442A at a position between the discharge roller pair 460A and the reverse roller pair 810A. The flap 820A is located at a position higher than the straight portion 442A, and extends in the conveyance direction 5A from a shaft 821A extending along the left-right direction 9. The flap 820A is supported so as to rotatably move between a discharge position and a reverse position about the shaft 821A. The discharge position is a position where the sheet 1A is dischargeable to the discharge tray 420A, and the flap 820A substantially extends along the upper side of the straight portion 442A. The reverse position is a position where the extended end of the flap 820A is located at a position lower than the extended end of the flap 820A in the discharge position. In FIG. 13, the flap 820A in the discharge position is indicated by a solid line, and the flap 820A in the reverse position is indicated by a broken line.

When no force other than gravity is applied to the flap 820A, the flap 820A is in the reverse position due to its own weight. When the flap 820A is in contact with the sheet 1A conveyed through the straight portion 442A, the flap 820A is lifted by the sheet 1A to the discharge position from the reverse position. Accordingly, when the rear end of the sheet 1A reaches the extended end of the flap 820A, the flap 820A rotatably moves to the reverse position from the discharge position due to its own weight. As a result, the rear end of the sheet 1A is directed to the reverse conveyance path 830A described later. When the rotation of the reverse roller pair 810A in the forward direction is continued in this state, the sheet 1A is conveyed in the conveyance direction 5A, and is discharged to the discharge tray 420A. When the rotation direction of the reverse roller pair 810A is switched to the opposite direction, the sheet 1A is conveyed in a direction opposite to the conveyance direction 5A, and is conveyed to a curved portion 441A through the reverse conveyance path 830A.

The reverse conveyance path 830A connects a branch position of the straight portion 442A with a merging position of the curved portion 441A, the branch position being located between the discharge roller pair 460A and the reverse roller pair 810A, the merging position being located upstream of the conveyance roller pair 450A. More specifically, the reverse conveyance path 830A extends rearward from the branch position, passes through between the platen 470A and the supply tray 410A in the vertical direction 7, and then reaches the merging position. The reverse conveyance path 830A is defined by an upper guide member and a lower guide member (not shown).

The flap 820B is substantially the same as the flap 820A except for that the flap 820B is supported at the straight portion 442B at a position between the discharge roller pair 460B and the reverse roller pair 810B and above the straight portion 442B so as to be rotatably move about a shaft 821B, extending along the left-right direction 9, between a reverse position and a discharge position. The reverse conveyance path 830B is substantially the same as the reverse conveyance path 830A except for that the reverse conveyance path 830B connects a branch position of the straight portion 442B with a merging position of the curved portion 441B, the branch position being located between the discharge roller pair 460B and the reverse roller pair 810B, the merging position being located upstream of the conveyance roller pair 450B. Therefore, the detailed description of the flap 820B and the reverse conveyance path 830B will be omitted.

According to the above configuration, the printer unit 400 records images on both sides of the sheets 1A and 1B (see FIG. 2).

The reverse roller pairs 810A, 810B, flaps 820A, 820B, and the reverse conveyance paths 830A, 830B are similarly applicable to the first to fifth modifications.

[Other Modifications]

In the embodiment, the marks 500C and 500D are provided near the supply trays 410A and 410B, respectively, and the marks 500B and 500A are provided near the discharge trays 420A and 420B, respectively. Alternatively, in the configuration where the printer unit 400 includes two supply trays 410A and 410B and two discharge trays 420A and 420B, the display unit may only include the marks 500B and 500C such that the mark 500C is provided near the supply tray 410A and the mark 500B is provided near the discharge tray 420A. In this configuration, too, the user can recognize not only the first correspondence but also the second correspondence between the supply tray 410B and the discharge tray 420B.

In the embodiment, each of the marks 500A to 500D is a mark in which the same outline is colored with paint. However, the set of marks 500A and 500D only need to display the first correspondence in a mode different from the set of marks 500B and 500C. In one example, the marks 500A to 500D have different shapes, the marks 500A and 500D have the same color, and the marks 500B and 500C have the same color. In another example, as shown in FIG. 14A, the marks 501A to 501D have different colors, and the marks 501A and 501D have the same shape (for example, a rectangle) and the marks 501B and 501C have the same shape (for example, a triangle). In still another example, the marks 501A to 501D have different colors and shapes. For example, as shown in FIG. 14B, the marks 501A and 501D include the same letter (character) or symbol (for example, "A" or "1"), and the marks 501B and 501C include the same letter or symbol (for example, "B" or "2").

In the embodiment, each of the marks 500A to 500D is painted. Alternatively, each of the marks 500A to 500D may be affixed in a state of being recorded on a sticker or a label. Alternatively, the marks 500A to 500D may be engraved.

In the embodiment, the marks 500A to 500D are provided on the front surface 201. Alternatively, the marks 500A and 500B may be provided on the side surface of the housing 200 at positions close to the discharge trays 420B and 420A in the vertical direction 7, respectively. Further, the marks 500C and 500D may be provided on the side surface of the housing 200 at positions close to the supply trays 410A and 410B in the vertical direction 7, respectively.

Figure 14C:
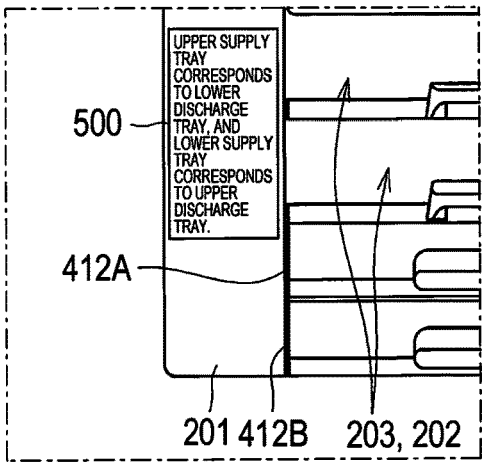

In the embodiment, the first display 500 includes the marks 500A to 500D. Alternatively, as shown in FIG. 14C, the first display 500 may be, for example, a single sticker or label on which texts are recorded such as "UPPER SUPPLY TRAY CORRESPONDS TO LOWER DISCHARGE TRAY, AND LOWER SUPPLY TRAY CORRESPONDS TO UPPER DISCHARGE TRAY." The sticker or label is affixed to the front surface 201 or the side surface of the housing 200.

In the embodiment, the number of supply trays and the number of discharge trays are two. Alternatively, the number of supply trays and the number of discharge trays may be three or more.

In the embodiment, the discharge trays 420A and 420B are mounted in the housing 200. Alternatively, the discharge trays 420A and 420B may extend from the outer surface of the housing 200.

While the disclosure has been described in detail with reference to the above aspects thereof, it would be apparent to those skilled in the art that various changes and modifications may be made therein without departing from the scope of the claims.

According to another aspect, this specification also discloses an image recording apparatus. The image recording apparatus includes a housing, a scanner, and a printer. The scanner is provided at an upper part of the housing and configured to scan an image on a document. The printer is provided in the housing and located below the scanner. The printer includes a first supply tray, a second supply tray, a first print engine, and a second print engine. The first supply tray is configured to be mounted to the housing in a first direction. The first supply tray is configured to support a sheet to be conveyed along a first conveyance path. The first conveyance path has a first upward portion extending upward from a downstream end of the first supply tray with respect to the first direction, and a first straight portion continuing from the first upward portion and extending in a second direction opposite the first direction. The second supply tray is configured to be mounted to the housing in the first direction. The second supply tray is located below the first supply tray in a state where the first supply tray and the second supply tray are mounted in the housing. The second supply tray is configured to support a sheet to be conveyed along a second conveyance path. The second conveyance path has a second upward portion extending upward from a downstream end of the second supply tray with respect to the first direction, and a second straight portion continuing from the second upward portion and extending in the second direction. The second upward portion is located at a position downstream of the first upward portion with respect to the first direction. The second straight portion is located at a higher position than the first straight portion. The first print engine is configured to record an image on a sheet conveyed along the first straight portion. The second print engine is configured to record an image on a sheet conveyed along the second straight portion. The second print engine is located at a higher position than the first print engine.

According to another aspect, this specification also discloses an image recording apparatus. The image recording apparatus includes a housing, a first supply tray, a second supply tray, a first print engine, a second print engine, a first discharge tray, a second discharge tray, and a liquid cartridge. The first supply tray is configured to be mounted to the housing in a first direction. The first supply tray is configured to support a sheet to be conveyed along a first conveyance path. The first conveyance path has a first upward portion extending upward from a downstream end of the first supply tray with respect to the first direction, and a first straight portion continuing from the first upward portion and extending in a second direction opposite the first direction. The second supply tray is configured to be mounted to the housing in the first direction. The second supply tray is located below the first supply tray in a state where the first supply tray and the second supply tray are mounted in the housing. The second supply tray is configured to support a sheet to be conveyed along a second conveyance path. The second conveyance path has a second upward portion extending upward from a downstream end of the second supply tray with respect to the first direction, and a second straight portion continuing from the second upward portion and extending in the second direction. The second upward portion is located at a position downstream of the first upward portion with respect to the first direction. The second straight portion is located at a higher position than the first straight portion. The first print engine is configured to record an image on a sheet conveyed along the first straight portion. The second print engine is configured to record an image on a sheet conveyed along the second straight portion. The second print engine is located at a higher position than the first print engine. The first discharge tray is configured to receive a sheet on which an image is recorded by the first print engine. The second discharge tray is configured to receive a sheet on which an image is recorded by the second print engine. The second discharge tray is located at a higher position than the first discharge tray. The liquid cartridge is configured to store liquid to be supplied to the first print engine or the second print engine. The liquid cartridge is located at a position shifted in a third direction from the first discharge tray or the second discharge tray, the third direction being perpendicular to both the first direction and a vertical direction.

According to another aspect, this specification also discloses an image recording apparatus. The image recording apparatus includes a housing, a first supply tray, a second supply tray, a first print engine, a second print engine, a first liquid cartridge, and a second liquid cartridge. The first supply tray is configured to be mounted to the housing in a first direction. The first supply tray is configured to support a sheet to be conveyed along a first conveyance path. The first conveyance path has a first upward portion extending upward from a downstream end of the first supply tray with respect to the first direction, and a first straight portion continuing from the first upward portion and extending in a second direction opposite the first direction. The second supply tray is configured to be mounted to the housing in the first direction. The second supply tray is located below the first supply tray in a state where the first supply tray and the second supply tray are mounted in the housing. The second supply tray is configured to support a sheet to be conveyed along a second conveyance path. The second conveyance path has a second upward portion extending upward from a downstream end of the second supply tray with respect to the first direction, and a second straight portion continuing from the second upward portion and extending in the second direction. The second upward portion is located at a position downstream of the first upward portion with respect to the first direction. The second straight portion is located at a higher position than the first straight portion. The first print engine is configured to record an image on a sheet conveyed along the first straight portion. The second print engine is configured to record an image on a sheet conveyed along the second straight portion. The second print engine is located at a higher position than the first print engine. The first liquid cartridge is configured to store liquid to be supplied to the first print engine. The second liquid cartridge is configured to store liquid to be supplied to the second print engine. The second liquid cartridge is located above the first liquid cartridge.

According to another aspect, this specification also discloses an image recording apparatus. The image recording apparatus includes a housing, a first supply tray, a second supply tray, a first print engine, a second print engine, and an operation panel. The first supply tray is configured to be mounted to the housing in a first direction. The first supply tray is configured to support a sheet to be conveyed along a first conveyance path. The first conveyance path has a first upward portion extending upward from a downstream end of the first supply tray with respect to the first direction, and a first straight portion continuing from the first upward portion and extending in a second direction opposite the first direction. The second supply tray is configured to be mounted to the housing in the first direction. The second supply tray is located below the first supply tray in a state where the first supply tray and the second supply tray are mounted in the housing. The second supply tray is configured to support a sheet to be conveyed along a second conveyance path. The second conveyance path has a second upward portion extending upward from a downstream end of the second supply tray with respect to the first direction, and a second straight portion continuing from the second upward portion and extending in the second direction. The second upward portion is located at a position downstream of the first upward portion with respect to the first direction. The second straight portion is located at a higher position than the first straight portion. The first print engine is configured to record an image on a sheet conveyed along the first straight portion. The second print engine is configured to record an image on a sheet conveyed along the second straight portion. The second print engine is located at a higher position than the first print engine. The operation panel is provided at the housing at a position higher than the second print engine.

What is claimed is:

1. An image recording apparatus comprising:

a housing;

a first supply tray configured to support a sheet;

a second supply tray configured to support a sheet;

a first print engine arranged in the housing and configured to record an image on the sheet conveyed from the first supply tray;

a second print engine arranged in the housing and configured to record an image on the sheet conveyed from the second supply tray;

a first discharge tray configured to support the sheet on which the image is recorded by the first print engine;

a second discharge tray configured to support the sheet on which the image is recorded by the second print engine; and a controller configured to:

generate at least first data or second data, the first data indicating a first correspondence that the first supply tray and the first discharge tray correspond to each other, the second data indicating a second correspondence that the second supply tray and the second discharge tray correspond to each other.

2. The image recording apparatus according to claim 1, wherein the controller transmits at least the first data or the second data.

3. The image recording apparatus according to claim 1, further comprising:

a first display configured to display at least the first data or the second data.

4. The image recording apparatus according to claim 3, wherein the first display is configured to display the first correspondence and the second correspondence in modes different from each other.

5. The image recording apparatus according to claim 4, wherein the first display is configured to display the second correspondence by using at least a letter, a symbol, a color, or a shape that is different from the first correspondence.

6. The image recording apparatus according to claim 3, wherein the first display displays a first mark indicating the first correspondence and a second mark indicating the second correspondence;

wherein the first mark is located at a position closer to the first discharge tray and the first supply tray than to the second discharge tray and the second supply tray; and wherein the second mark is located at a position closer to the second discharge tray and the second supply tray than to the first discharge tray and the first supply tray.

7. The image recording apparatus according to claim 3, wherein the first display includes a first light emitting element and a second light emitting element;

wherein the first light emitting element is located at a position closer to the first discharge tray and the first supply tray than to the second discharge tray and the second supply tray, the first light emitting element being configured to emit light of a first color indicating the first correspondence; and wherein the second light emitting element is located at a position closer to the second discharge tray and the second supply tray than to the first discharge tray and the first supply tray, the second light emitting element being configured to emit light of a second color indicating the second correspondence and different from the first color.

8. The image recording apparatus according to claim 7, wherein a first conveyance path and a second conveyance path are formed in the housing, the first conveyance path extending from the first supply tray to the first discharge tray, the second conveyance path extending from the second supply tray to the second discharge tray; and wherein the image recording apparatus further comprises:

a first sheet sensor configured to output a first sheet signal having different levels depending on whether a sheet is located at a first particular position in the first conveyance path;

a second sheet sensor configured to output a second sheet signal having different levels depending on whether a sheet is located at a second particular position in the second conveyance path;

a first tray sensor configured to output a first tray signal having different levels depending on whether the first supply tray is located at a first mount position;

a second tray sensor configured to output a second tray signal having different levels depending on whether the second supply tray is located at a second mount position; and wherein the controller is configured to:

in response to detecting that the first tray signal is at a particular level, control the first light emitting element to emit light in a first mode;

in response to detecting that the second tray signal is at a particular level, control the second light emitting element to emit light in a second mode;

determine whether there is a jam of a sheet in each of the first conveyance path and the second conveyance path based on the first sheet signal and the second sheet signal;

in response to detecting that the second tray signal changes from the particular level to another level after determining that there is a jam in the first conveyance path, control the first light emitting element to emit light in a mode or a color different from the first mode; and in response to detecting that the first tray signal changes from the particular level to another level after determining that there is a jam in the second conveyance path, control the second light emitting element to emit light in a mode or a color different from the second mode.

9. The image recording apparatus according to claim 7, further comprising a communication interface, wherein the controller is configured to:

in response to acquiring no job through the communication interface, control the first light emitting element to emit light in a first mode and control the second light emitting element to emit light in a second mode;

in response to acquiring a job through the communication interface, select at least the first supply tray or the second supply tray;

in response to selecting the first supply tray, control the first light emitting element to emit light in a mode or a color different from the first mode; and in response to selecting the second supply tray, control the second light emitting element to emit light in a mode or a color different from the second mode.

10. The image recording apparatus according to claim 3, wherein the first display is located at a front surface of the housing at a position laterally shifted from the second discharge tray, the first discharge tray, the first supply tray, and the second supply tray, the first display being configured to display a first image indicating the first correspondence and a second image indicating the second correspondence based on image data;

wherein the first image is displayed at a position laterally shifted from each of the first discharge tray and the first supply tray; and wherein the second image is displayed at a position laterally shifted from each of the second discharge tray and the second supply tray.

11. The image recording apparatus according to claim 10, further comprising a communication interface, wherein the controller is configured to:

in response to acquiring no job through the communication interface, control the first display to display the first image in a first mode and the second image in a second mode;

in response to acquiring a job through the communication interface, select one of the first supply tray and the second supply tray;

in response to selecting the first supply tray, control the first display to display the first image in a mode or a color different from the first mode; and in response to selecting the second supply tray, control the first display to display the second image in a mode or a color different from the second mode.

12. The image recording apparatus according to claim 3, wherein each of the first print engine and the second print engine is configured to eject ink; and wherein the image recording apparatus further comprises:

first reservoir located in the housing and configured to store ink to be ejected by the first print engine;

a second reservoir located in the housing and configured to store ink to be ejected by the second print engine;

a cover supported by the housing so as to move between an open position at which the first reservoir and the second reservoir are exposed and a closed position at which the first reservoir and the second reservoir are covered; and a second display configured to display at least:

a third correspondence between the first reservoir and at least the first supply tray, the first print engine, or the first discharge tray; or a fourth correspondence between the second reservoir and at least the second supply tray, the second print engine, or the second discharge tray.

13. The image recording apparatus according to claim 12, wherein the second display is configured to, on an outer surface of the cover, display the third correspondence at a position closer to the first reservoir than to the second reservoir, and display the fourth correspondence at a position closer to the second reservoir than to the first reservoir.

14. The image recording apparatus according to claim 12, wherein the first reservoir and the second reservoir are arranged in a vertical direction in the housing, the first reservoir being located at a position laterally shifted from the first discharge tray, the second reservoir being located at a position laterally shifted from the second discharge tray;

wherein the second display displays a linear mark extending laterally on an outer surface of the cover; and wherein the linear mark is located between the first reservoir and the second reservoir in the vertical direction.

15. The image recording apparatus according to claim 12, wherein the first reservoir is mounted in the housing through a first opening formed in a front surface of the housing;

wherein the second reservoir is mounted in the housing through a second opening formed in the front surface of the housing;

wherein the second display displays a third mark indicating the third correspondence and a fourth mark indicating the fourth correspondence;

wherein the third mark is located on a front surface of the housing at a position closer to the first reservoir than to the second reservoir; and wherein the fourth mark is located on the front surface of the housing at a position closer to the second reservoir than to the first reservoir.

16. The image recording apparatus according to claim 12, wherein the second display is configured to display the third correspondence in a same mode as the first correspondence, and to display the fourth correspondence in a same mode as the second correspondence.

17. The image recording apparatus according to claim 3, wherein each of the first print engine and the second print engine is configured to eject ink; and wherein the image recording apparatus further comprises:

a first reservoir located in the housing and configured to store ink to be ejected by the first print engine;

a second reservoir located in the housing and configured to store ink to be ejected by the second print engine;

a first cover supported by the housing so as to move between a first open position at which the first reservoir is exposed and a first closed position at which the first reservoir is covered;

a second cover supported by the housing so as to move between a second open position at which the second reservoir is exposed and a second closed position at which the second reservoir is covered; and a second display configured to display at least:

a third correspondence between the first reservoir and at least the first supply tray, the first print engine, or the first discharge tray; or a fourth correspondence between the second reservoir and at least the second supply tray, the second print engine, or the second discharge tray.

18. The image recording apparatus according to claim 17, wherein the second display is configured to display the third correspondence on an outer surface of the first cover, and to display the fourth correspondence on an outer surface of the second cover.

19. The image recording apparatus according to claim 1, comprising:

wherein the first supply tray, the second supply tray, the first print engine, and the second print engine are arranged in the housing;

wherein the first print engine is arranged at a position higher than the first supply tray;

wherein the second print engine is arranged at a position higher than the second supply tray; and wherein the first print engine and first supply tray are arranged between the second print engine and the second supply tray in a vertical direction.

20. The image recording apparatus according to claim 1, wherein the first supply tray and the second supply tray are arranged in a vertical direction in the housing; and wherein the second discharge tray and the first discharge tray are arranged in the vertical direction at higher positions than the first supply tray.

21. The image recording apparatus according to claim 1, further comprising:

an additional supply tray mounted at a lower position than the second supply tray and configured to support a sheet to be conveyed to the second print engine; and a display configured to display another correspondence between the additional supply tray and the second discharge tray.

* * * * *